US010980339B2

(12) United States Patent
Game et al.

(10) Patent No.: US 10,980,339 B2
(45) Date of Patent: Apr. 20, 2021

(54) EQUIPMENT MOUNTING APPARATUS FOR CONSOLE

(71) Applicant: Evans Consoles Corporation, Calgary (CA)

(72) Inventors: Richard Game, Calgary (CA); Matko Papic, Calgary (CA); Carlos Renderos, Calgary (CA); Randy Simington, Calgary (CA); Damien Coroller, Calgary (CA)

(73) Assignee: EVANS CONSOLES CORPORATION, Calgary (CA)

( * ) Notice: Subject to any disclaimer, the term of this patent is extended or adjusted under 35 U.S.C. 154(b) by 0 days.

(21) Appl. No.: 15/965,145

(22) Filed: Apr. 27, 2018

(65) Prior Publication Data

US 2018/0310705 A1 Nov. 1, 2018

Related U.S. Application Data

(60) Provisional application No. 62/491,789, filed on Apr. 28, 2017.

(51) Int. Cl.
*A47B 21/04* (2006.01)
*A47B 21/02* (2006.01)
(Continued)

(52) U.S. Cl.
CPC ..... *A47B 21/04* (2013.01); *A47B 21/02* (2013.01); *A47B 21/03* (2013.01);
(Continued)

(58) Field of Classification Search
CPC ..... A47B 21/00; A47B 21/02; A47B 21/03; A47B 21/0314; A47B 21/04;
(Continued)

(56) References Cited

U.S. PATENT DOCUMENTS 4,762,072 A * 8/1988 Boundy ..... A47B 21/06 108/50.02
4,852,500 A * 8/1989 Ryburg ..... A47B 21/03 108/105
(Continued)

FOREIGN PATENT DOCUMENTS

DE 202014010407 U1 * 6/2015 ..... A47B 21/03
WO WO-2006038649 A1 * 4/2006 ..... A47B 21/00
(Continued)

OTHER PUBLICATIONS

Extended European Search Report for corresponding application No. EP 18169748.3, dated Jun. 14, 2018.

*Primary Examiner* — Jose V Chen
(74) *Attorney, Agent, or Firm* — Notaro, Michalos & Zaccaria P.C.

(57) ABSTRACT

Equipment, such as one or more displays, may be mounted on a console. Conventional equipment mounting structures, such as a slat rail, may be static and/or not allow for easy or simple adjustment of their position relative to the work surface. An apparatus for use with a console is provided that includes an equipment mounting structure for mounting equipment thereto and a position adjustment assembly attachable to the console. The equipment mounting structure is mounted to and supported by the position adjustment assembly, the position adjustment assembly includes at least one of: a horizontal adjustment mechanism for adjusting a horizontal position of the equipment mounting structure relative to the console; and a vertical adjustment mechanism for adjusting a vertical position of the equipment mounting structure relative to the console.

17 Claims, 29 Drawing Sheets

(51) Int. Cl.
*A47B 21/03* (2006.01)
*A47B 81/06* (2006.01)
*A47B 83/00* (2006.01)

(52) U.S. Cl.
CPC ..... *A47B 21/0314* (2013.01); *A47B 81/062* (2013.01); *A47B 81/064* (2013.01); *A47B 2083/006* (2013.01); *A47B 2200/0066* (2013.01)

(58) Field of Classification Search
CPC ..... A47B 2200/0066; A47B 81/062; A47B 81/064; A47B 2083/066
USPC ..... 108/50.01, 50.02
See application file for complete search history.

(56) References Cited

U.S. PATENT DOCUMENTS 5,174,223 A * 12/1992 Nagy ..... A47B 21/00 108/50.01
5,909,934 A * 6/1999 McGraw ..... A47B 21/00 297/188.21
5,988,076 A * 11/1999 Vander Park ..... A47B 21/06 108/50.02
6,248,014 B1 * 6/2001 Collier ..... A47B 21/00 454/186
6,296,408 B1 * 10/2001 Larkin ..... A47B 83/001 400/681
7,640,866 B1 * 1/2010 Schermerhorn ..... A47B 21/00 108/5
7,823,973 B2 * 11/2010 Dragusin ..... A47C 7/72 108/50.01
7,878,476 B2 * 2/2011 Carson ..... B60R 11/0235 211/26
8,051,782 B2 * 11/2011 Nethken ..... A47B 21/02 108/50.01
8,662,605 B2 * 3/2014 McRorie ..... B62B 3/02 108/38
8,893,628 B2 * 11/2014 McKenzie, III ..... A47B 21/02 108/50.01
8,991,320 B2 * 3/2015 DesRoches ..... A47B 21/02 108/147
9,560,913 B2 * 2/2017 Scharing ..... A47B 21/03
2004/0100167 A1 * 5/2004 Rudolf ..... A47B 21/00 312/223.3
2006/0119233 A1 * 6/2006 Thomas ..... A47B 21/00 312/235.9
2006/0174807 A1 * 8/2006 Dral ..... A47B 21/0073 108/50.01
2009/0133609 A1 * 5/2009 Nethken ..... A47B 21/02 108/50.02
2009/0293773 A1 * 12/2009 Miller ..... A47B 21/00 108/28
2010/0201165 A1 * 8/2010 Dankovich ..... A47B 83/001 297/135
2010/0302454 A1 * 12/2010 Epstein ..... H04N 5/268 348/705
2012/0031310 A1 2/2012 Jedrysik et al.
2013/0106146 A1 * 5/2013 Leclaire ..... E05B 75/00 297/135
2013/0255544 A1 * 10/2013 Scharing ..... A47B 21/00 108/50.01
2014/0245932 A1 9/2014 McKenzie et al.
2015/0138304 A1 * 5/2015 McArdell ..... A47B 21/00 348/14.07

FOREIGN PATENT DOCUMENTS

WO WO-2006041076 A1 * 4/2006 ..... A47B 21/00
WO 2016/093715 A1 6/2016

* cited by examiner

EQUIPMENT MOUNTING APPARATUS FOR CONSOLE

RELATED APPLICATION

The present disclosure claims priority to U.S. Provisional Patent App. No. 62/491,789 filed on Apr. 28, 2017, the entire content of which is incorporated by reference.

FIELD OF THE DISCLOSURE

The present disclosure relates to apparatuses for mounting equipment such as displays on a console or other furniture. More particularly, the disclosure relates to movable mounting apparatuses.

BACKGROUND

Consoles are used in a variety of different applications, including in control rooms, on trading floors, and in operations centers. Consoles are typically used in the place of generic office equipment. Consoles may provide an enhanced human-machine interface by allowing for the positioning of equipment in more useful and efficient positions. Furthermore, consoles may be adapted to support more equipment compared to generic office equipment.

Equipment, such as one or more displays, may be mounted on a console or other furniture (e.g. desk, work counter, etc.). For example, a console may include a slat rail or slat wall to which various equipment may be mounted. The slat rail or slat wall may be mounted over a work surface of the console.

Conventional equipment mounting structures, such as a slat rail, may be static and/or not allow for easy or simple adjustment of their position relative to the work surface.

SUMMARY

According to an aspect of the disclosure, there is provided an apparatus for use with a console, the apparatus comprising: an equipment mounting structure for mounting equipment thereto; and a position adjustment assembly mountable to the console, the equipment mounting structure being mounted to and supported by the position adjustment assembly, the position adjustment assembly comprising at least one of: a horizontal adjustment mechanism for adjusting a horizontal position of the equipment mounting structure relative to the console; and a vertical adjustment mechanism for adjusting a vertical position of the equipment mounting structure relative to the console.

In some embodiments, the horizontal adjustment mechanism comprises at least one guide rail.

In some embodiments, the vertical adjustment mechanism comprises at least one vertical lift.

In some embodiments, the position adjustment assembly further comprises a support structure, the horizontal adjustment mechanism and the vertical adjustment mechanism each being connected to the support structure.

In some embodiments, the horizontal adjustment mechanism is mountable to the work surface of the console, the support structure is mounted to the horizontal adjustment mechanism, and the vertical adjustment mechanism is mounted to the support structure.

In some embodiments, the console comprises a work surface and the horizontal adjustment mechanism comprises at least one guiderail mountable to the work surface.

In some embodiments, the apparatus further comprises a horizontal actuator and a motor, wherein the horizontal actuator is coupled to the support structure, and the motor drives the horizontal actuator to move the support structure horizontally relative to the at least one guiderail.

In some embodiments, the equipment mounting structure is connected to the at least one vertical lift and is vertically adjustable relative to the support structure.

In some embodiments, the console comprises one or more leg structures, and the apparatus is connected to the one or more leg structures of the console.

In some embodiments, the apparatus further comprises one or more feet, each of the one or more feet of the apparatus being connectable to a respective one of the one or more leg structures of the console.

In some embodiments, the horizontal adjustment mechanism is mounted to the one or more feet of the apparatus, the support structure is mounted to the horizontal adjustment mechanism, and the vertical adjustment mechanism is mounted to the support structure.

In some embodiments, the horizontal adjustment mechanism comprises at least one guiderail, and each said at least one guide rail is mounted to a respective one of said one or more feet of the apparatus.

In some embodiments, said support structure is a first support structure, the apparatus further comprises a second support structure that is above the first support structure, and the vertical adjustment mechanism interconnects the first and second support structures.

In some embodiments, the equipment mounting structure is connected to the second support structure.

In some embodiments, the equipment mounting structure comprises one of: a slat rail and a slat wall.

In some embodiments, the console comprises a work surface that is vertically adjustable, and at least one of the horizontal adjustment mechanism and the vertical adjustment mechanism comprises a controller that automatically adjusts the position of the equipment mounting structure responsive to vertical movement of the work surface.

According to an aspect of the disclosure, there is provided a console system comprising: a console comprising at least one work surface; and the apparatus as described above.

According to an aspect of the disclosure, there is provided a method comprising: providing an equipment mounting structure for mounting equipment thereto; and providing a position adjustment assembly that is mountable to a console, the position adjustment assembly comprising at least one of: a horizontal position adjustment mechanism; and a vertical adjustment mechanism; and mounting the equipment mounting structure to the position adjustment assembly, thereby allowing vertical and horizontal adjustment of a position of the equipment mounting structure.

In some embodiments, the method further comprises attaching the position adjustment assembly to a console, thereby allowing vertical and horizontal adjustment of the position of the equipment mounting structure relative to the console.

In some embodiments, providing the position adjustment assembly comprises coupling the vertical adjustment mechanism to the horizontal adjustment mechanism.

Other aspects and features of the present disclosure will become apparent, to those ordinarily skilled in the art, upon review of the following description of the specific embodiments.

BRIEF DESCRIPTION OF THE DRAWINGS

Aspects and embodiments of the disclosure will now be described in greater detail with reference to the accompanying diagrams, in which.

DETAILED DESCRIPTION

According to one aspect, there is provided an equipment mounting apparatus for a console. The apparatus may be mounted on a work surface of a console. The apparatus may include an equipment mounting structure, such as a slat rail for mounting equipment, such as one or more displays, thereto. The apparatus may allow adjustment of the vertical and/or horizontal position of the equipment mounting structure, thereby also allowing adjustment of the position of equipment mounted to the apparatus.

In this disclosure, the side of a console at which a user is normally positioned (sitting or standing) to use the console will be referred to as the "front" of the console. The side opposite to the front will be referred to as the "rear" or "back" of the console. These terms are used for descriptive purposes only and are not intended to limit or restrict the orientation of embodiments described herein.

The terms "vertical" and "horizontal" as used herein do not require absolute vertical or substantially horizontal alignment. Rather, these terms are meant to indicate substantially vertical or horizontal alignment or directions relative to a floor or ground surface that a console sits on in ordinary use. For example, a work surface (e.g. desktop or tabletop) of a console is typically horizontally aligned, but may be slightly angled, curved or otherwise deviate from an absolute horizontal plane. Similarly, "vertically aligned" elements may be angled somewhat from an absolute vertical axis.

Figure 1:
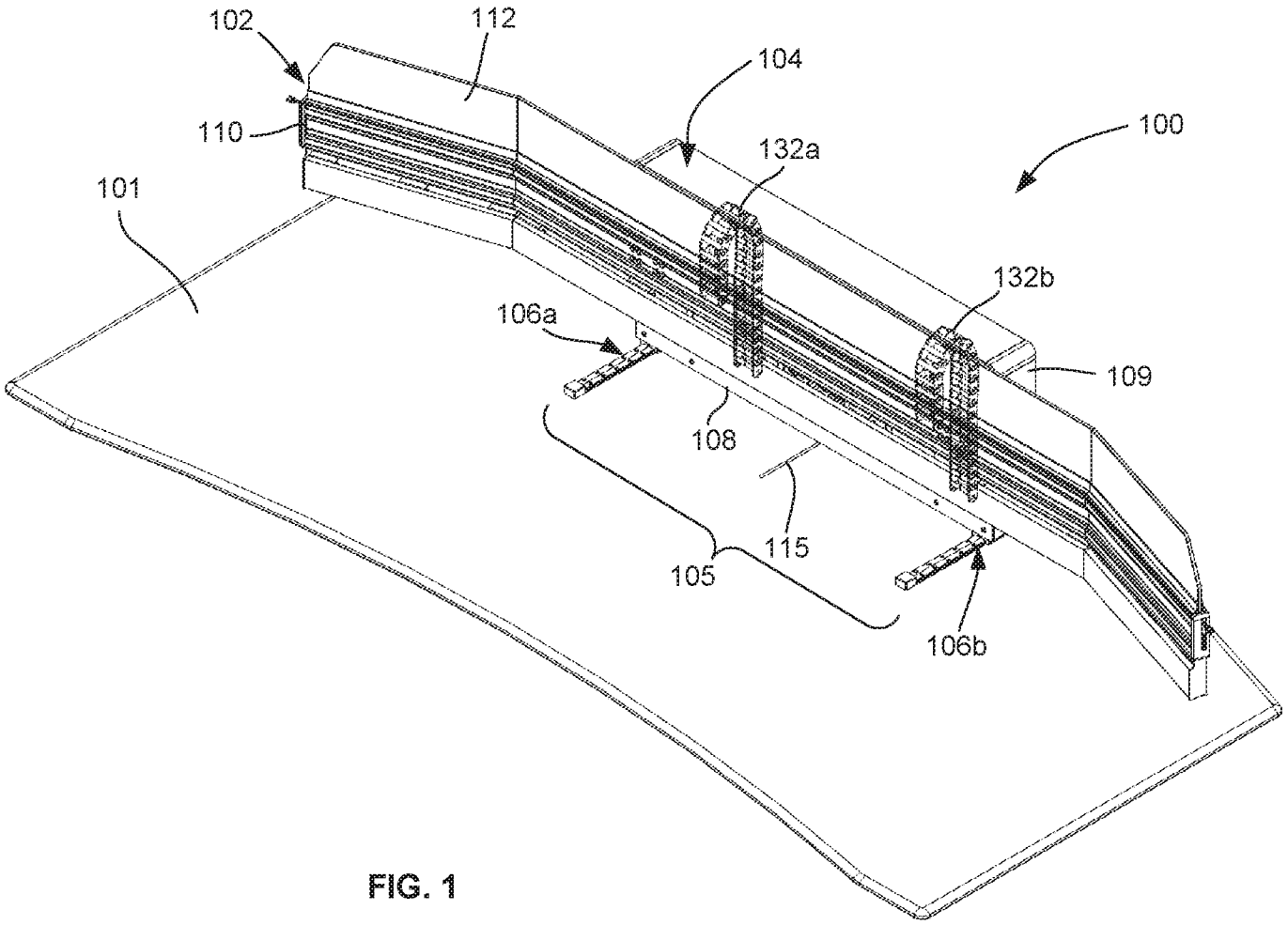
FIG. 1 is a front perspective view of an equipment mounting apparatus mounted on a work surface for a console according to one embodiment.
Figure 2:
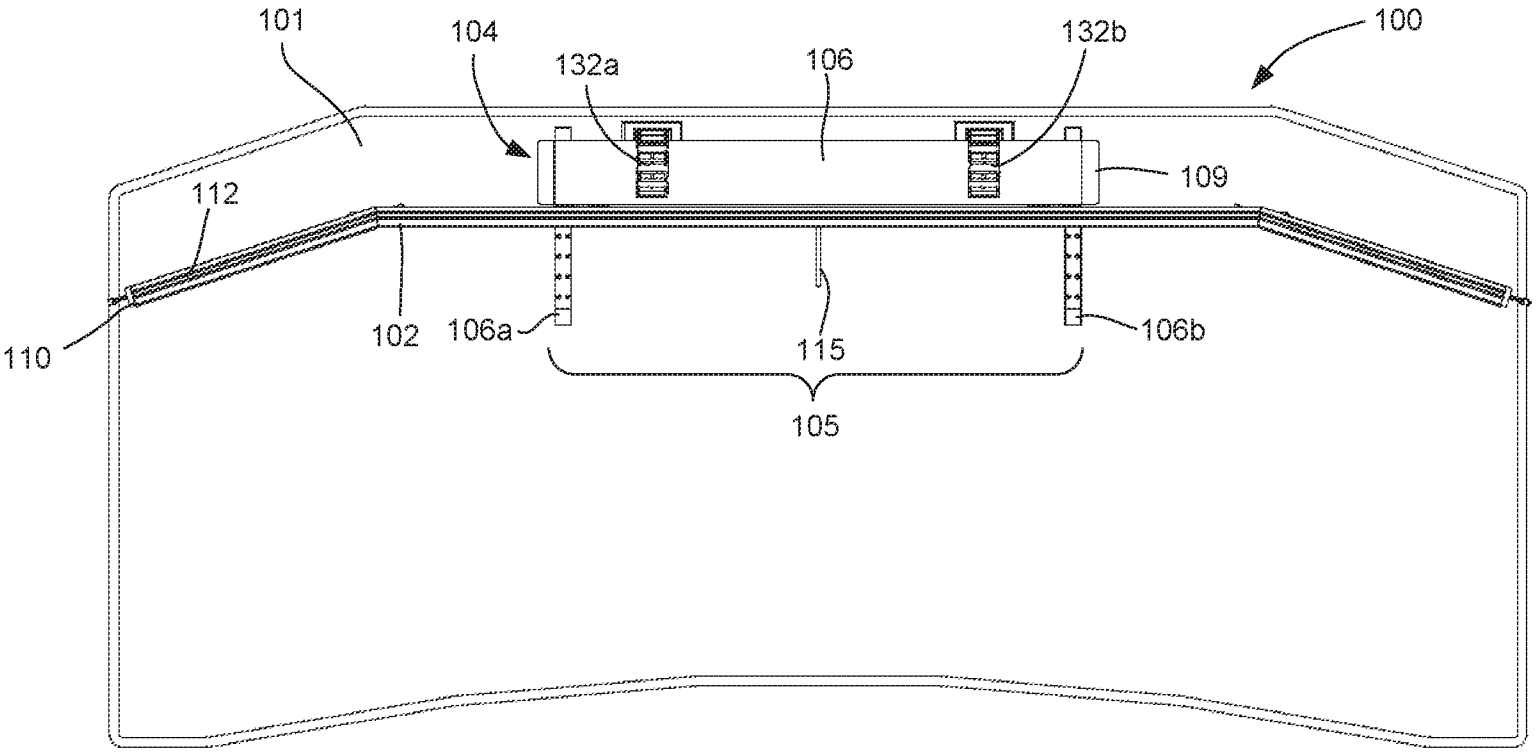
FIG. 2 is a top view of the apparatus and work surface of FIG. 1.
Figure 3:
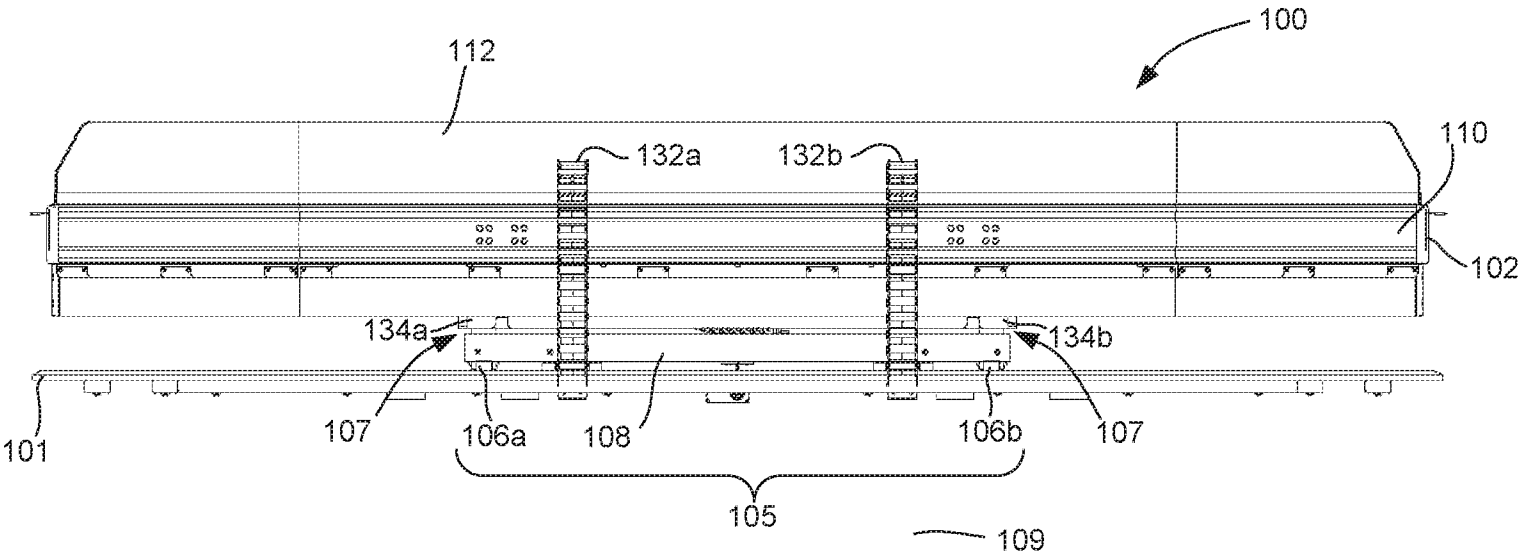
FIG. 3 is a front view of the apparatus and work surface of FIGS. 1 and 2.
Figure 4:
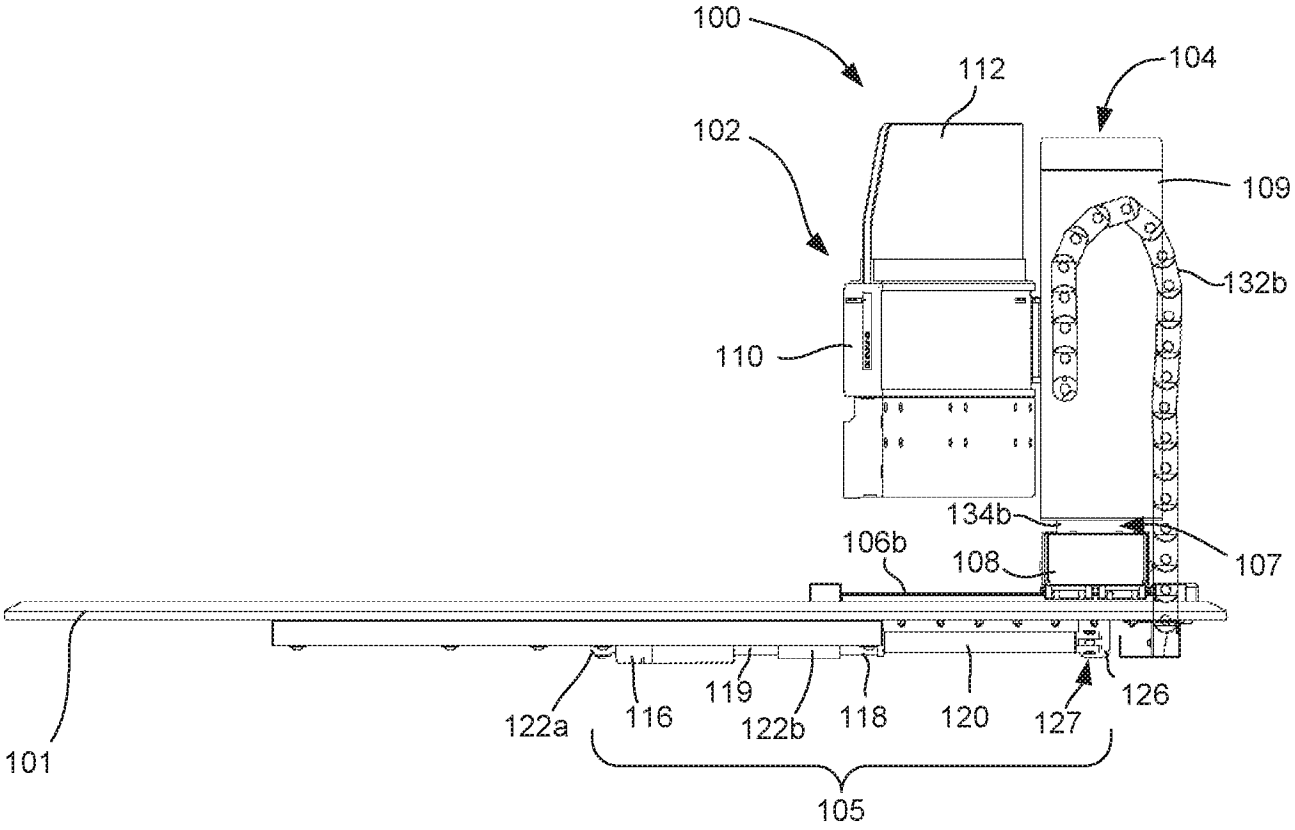
FIG. 4 is a side view of the apparatus and work surface of FIGS. 1 to 3.

FIG. 1 is a front perspective view of an equipment mounting apparatus 100, according to one embodiment, for use with a console comprising a work surface. FIG. 2 is a top view of the apparatus 100. FIG. 3 is a rear view of the apparatus 100. FIG. 4 is a side view of the apparatus 100. In FIGS. 1 to 4, the apparatus 100 is shown mounted on example console work surface 101 for illustrative purposes. The remainder of the console is not shown, but it is to be understood that the apparatus 100 may be mounted on a variety of different surfaces, consoles and furniture types.

The apparatus 100 includes an equipment mounting structure 102 and a position adjustment assembly 104. The equipment mounting structure 102 may be any structure to which various equipment (such as displays) may be mounted. The equipment mounting structure 102 is mounted to and supported by the position adjustment assembly 104.

The position adjustment assembly 104, in this embodiment, is mounted to the work surface 101. The position adjustment assembly comprises: a horizontal adjustment mechanism 105 for adjusting a horizontal position of the equipment mounting structure 104 relative to the work surface 101; and a vertical adjustment mechanism 107 (shown in FIGS. 3 and 4) for adjusting a vertical position of the equipment mounting structure 102 relative to the work surface 101. In other embodiments, the apparatus may omit the horizontal adjustment mechanism or the vertical adjustment mechanism.

Figure 6:
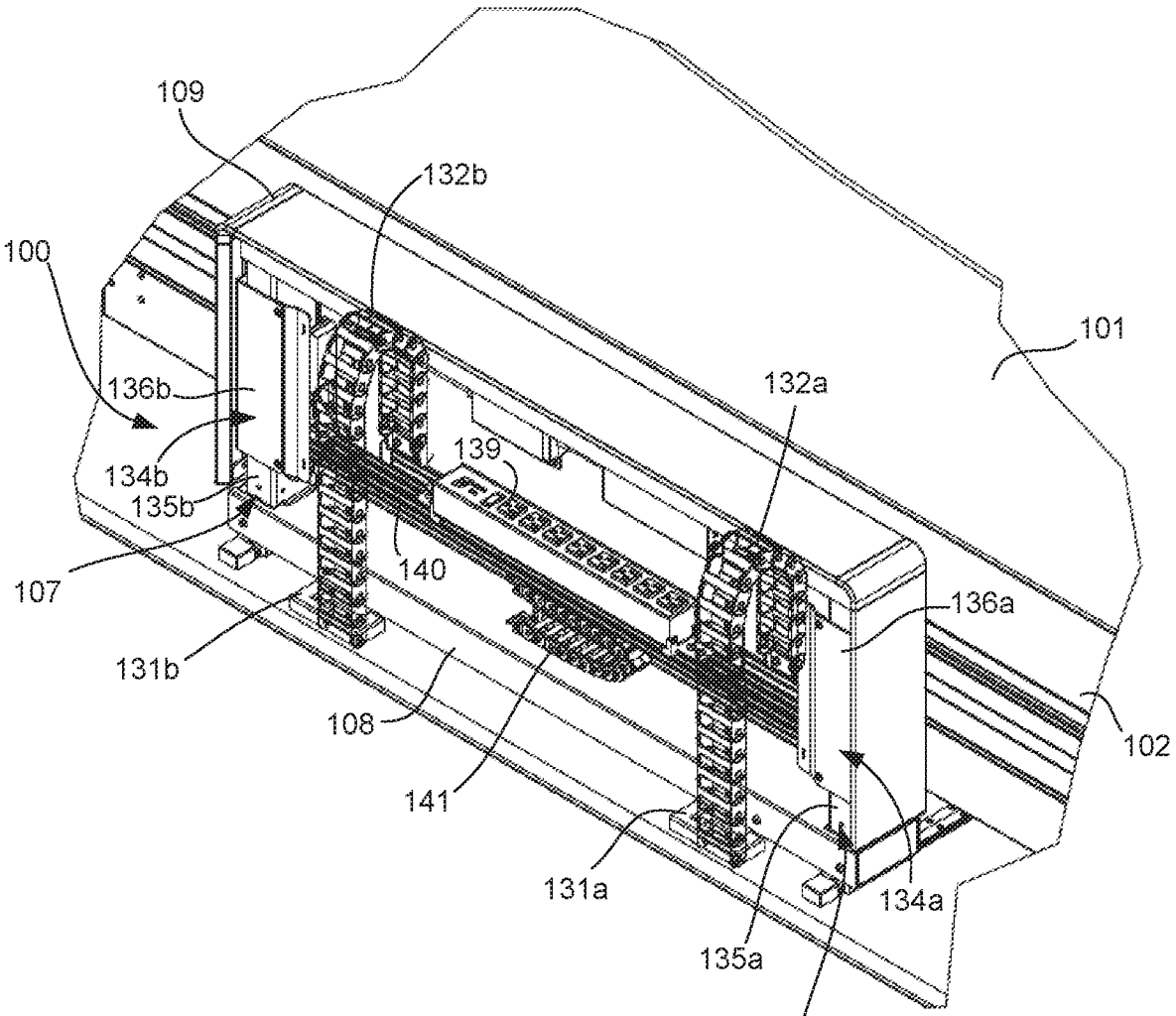
FIG. 6 is an enlarged, partial real perspective view of the apparatus and work surface of FIGS. 1 to 5.

In this example, the horizontal adjustment mechanism 105 includes first and second guide rails 106*a* and 106*b* that are mounted on the work surface 101, and the vertical adjustment mechanism 107 comprises first and second vertical lifts 134*a* and 134*b* (best shown in FIG. 6).

The position adjustment assembly 104 further includes a support structure 108 that is slidably mounted to the first and second guide rails 106*a* and 106*b*. The first and second vertical lifts 134*a* and 134*b* are, in turn, mounted to the support structure 108. Thus, the horizontal adjustment mechanism 105 (including the first and second guide rails 106*a* and 106*b*) and the vertical adjustment mechanism 107 (including the first and second vertical lifts 134*a* and 134*b*) are indirectly coupled together via the support structure 108. In other embodiments, the horizontal adjustment mechanism 105 and the vertical adjustment mechanism 107 may be directly connected to one another. The support structure 108 in this example is in the form of an elongated, horizontal frame member or beam, although other support structures may be used.

The equipment mounting structure 102 is coupled to the first and second vertical lifts 134*a* and 134*b* in this embodiment. Thus, the guide rails 106*a* and 106*b* provide for horizontal adjustment of the equipment mounting structure 102 and the vertical lifts 134*a* and 134*b* provide for vertical adjustment of the equipment mounting structure 102.

The position adjustment assembly 104 further includes an optional housing 109 attached to and covering the vertical lifts 134*a* and 134*b* (FIG. 6). Optional cable management chains 132*a* and 132*b* are also shown in FIGS. 1 to 3. The cable management chains 132*a* and 132*b* are arranged to provide a cable pathway that extends from the equipment mounting structure 102 through the work surface 101. For example, cables for power and/or data signals may be connected to equipment that is mounted to the apparatus (e.g. displays) and extend through interior spaces of the cable management chains 132*a* and 132*b* through the work surface 101 for connection to other equipment, power sources, etc. The cable management chains 132*a* and 132*b* are substantially contained within the housing 109, and would normally be at least partially hidden from view. However, the cable management chains 132*a* and 132*b* are shown visible through the housing 109 and equipment mounting structure 102 for illustrative purposes in FIGS. 1 to 4.

The example equipment mounting structure 102 shown in FIGS. 1 to 4 includes a forward-facing slat rail 110 and an optional edge-lit panel 112 above the slat rail 110 and extending substantially along its length. Various equipment, such as displays, speakers, etc. may be mounted to the slat rail 110. Embodiments are not limited to slat rails, and other equipment mounting structure may be included. For example, rather than or in addition to a slat rail, the apparatus may include a slat wall, a panel, one or more brackets for receiving fastening hardware, or any other structure suitable for mounting equipment thereto.

The edge-lit panel 112 extends along the length of the slat rail 110 and may function as a visual indicator system. For example, color, pattern, intensity or other lighting characteristics of the edge-lit panel 112 may indicate a status or condition such as an alarm state. The edge lit panel 112 may be made of transparent or semi-transparent material (e.g. plexiglass, glass, etc.). The edge-lit panel 112 may include an LED strip (not shown) that can provide a plurality of light colors and/or patterns in the panel 112. The edge-lit panel 112 may be connected to a controller (not shown) that controls the light color and/or pattern such that the light and/or pattern provides a status indication (e.g. visual alarms). Other visual indicator systems may be used together with or in place of the edge-lit panel 112. Other embodiments may omit any such visual indicator system.

The first and second guiderails 106*a* and 106*b* are parallel to each other and arranged in a transverse (front-back) direction with respect to the work surface 101. The support structure 108 is coupled to the guiderails 106*a* and 106*b* for sliding movement thereon. Thus, the support structure 108 and the equipment mounting structure 102 are movable forward and backward along the guiderails 106*a* and 106*b*. Lateral (side-to-side) movement may also be provided in other embodiments. The horizontal movement of the apparatus 100 may be driven manually in some embodiments. However, the example of FIGS. 1 to 4, the horizontal adjustment mechanism 105 is motor-driven as will now be described with reference to FIGS. 4 and 5.

Figure 5:
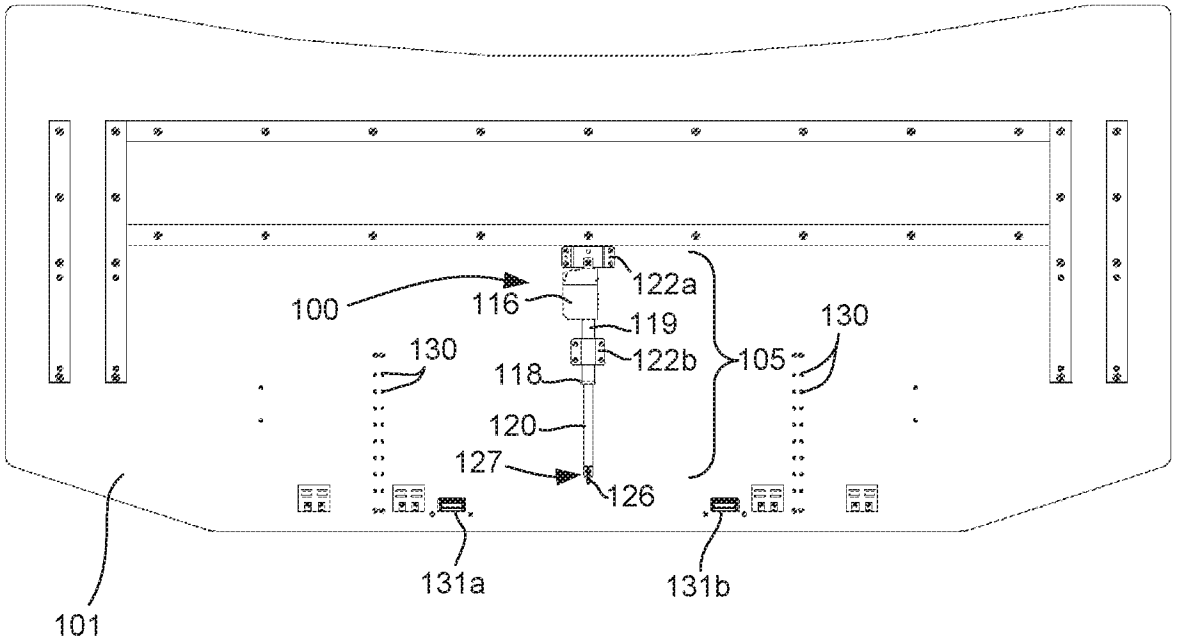
FIG. 5 is a bottom view of the apparatus and work surface of FIGS. 1 to 4.

FIG. 5 is a bottom view of the apparatus 100 and the work surface 101. As shown in FIGS. 4 and 5, the horizontal adjustment mechanism 105 of the apparatus 100 in this example further comprises a motor 116 and telescoping actuator 118 mounted below the work surface 101. The telescoping actuator 118 comprises a base 119 and a rod 120 that extends from and telescopes with the base 119. The motor 116 is coupled to and drives the telescoping actuator 118 to extend or retract the rod 120. The telescoping actuator 118 can, thus, expand or contract, as driven by the motor 116. The motor 116 and the telescoping actuator 118 are coupled to the work surface 101 by first and second brackets 122*a* and 122*b* respectively in this example, although any suitable method to fix a motor and actuator may be used in other embodiments. The first and second brackets 122*a* and 122*b* secure the position of the motor 116 and the base 119 of the actuator 118 relative to the work surface 101. The actuator 118 is also coupled to the support structure 108 (FIG. 4) that is slidably engaged to the guide rails 106*a* and 106*b*. Specifically, a connector piece 126 is connected to the rod 120 at a distal end 127 of the rod 120. The connector piece 126 extends upward through a slot 115 (shown in FIGS. 1 and 2) in the work surface 101 and connects to the support structure 108. The slot 115 provides clearance for horizontal movement of the connector piece 126 therein. For horizontal adjustment of the apparatus 100, the motor drives horizontal movement of the support structure 108 along the guide rails 106*a* and 106*b* via the actuator 118.

FIG. 5 also shows holes 130 in the work surface that receive fastening hardware (e.g. screws) to secure the guiderails 106*a* and 106*b* to the work surface 101. As will be appreciated, any means for mounting guiderails to a work surface may be used in other embodiments. Holes 131*a* and 131*b* are also provided in the work surface 101 that function as passageways for the cable management chains 132*a* and 132*b* respectively (shown in FIGS. 1 to 4).

The example vertical adjustment mechanism 107 of the apparatus 100 will now be described in more detail with reference to FIG. 6. FIG. 6 is a partial rear perspective view of the apparatus 100 and work surface 101. As shown, vertical adjustment mechanism 107 includes the first and second spaced apart lifts 134*a* and 134*b*. The housing 109 includes a removable rear cover 111 (shown in see FIG. 7B), which is removed in FIG. 6 so that the vertical lifts 134*a* and 134*b* are clearly shown. In this example, each vertical lift 134*a* and 134*b* includes a respective vertical rail 135*a* or 135*b* and a respective elevator member 136*a* or 136*b* engaged with the corresponding vertical rail 135*a* or 135*b*. The elevator members 136*a* and 136*b* are each configured for vertical movement along the respective vertical rail 135*a* and 135*b*. Any suitable structure for providing such vertical movement may be used, and embodiments are not limited to a particular type of vertical lift. The vertical lifts 134*a* and 134*b* also each include a respective motor (not shown) therein that is controllable to drive the vertical movement. In other embodiments, a manually adjustable lift or other manual vertical adjustment means may be used instead of the example vertical lifts 134*a* and 134*b* shown. The equipment mounting structure 102 is mounted to the elevator members 136*a* and 136*b* (in a forward-facing manner in this embodiment). Thus, the equipment mounting structure 102 may be adjusted vertically by the lifts 134*a* and 134*b* and/or horizontally along the guide rails 106*a* and 106*b*.

As also shown in FIG. 6, the interior of the housing 109 may be used as storage space for cables and/or other equipment. In this example embodiment, a cross beam 140 is connected between the elevator members 136*a* and 136*b*, which may help ensure the lifts 134*a* and 134*b* move together and prevent misalignment. An optional power bar 139 is shown installed on the cross beam 140. An additional cable management chain 141 under the cross beam 140 is also shown in FIG. 6.

Figure 7A:
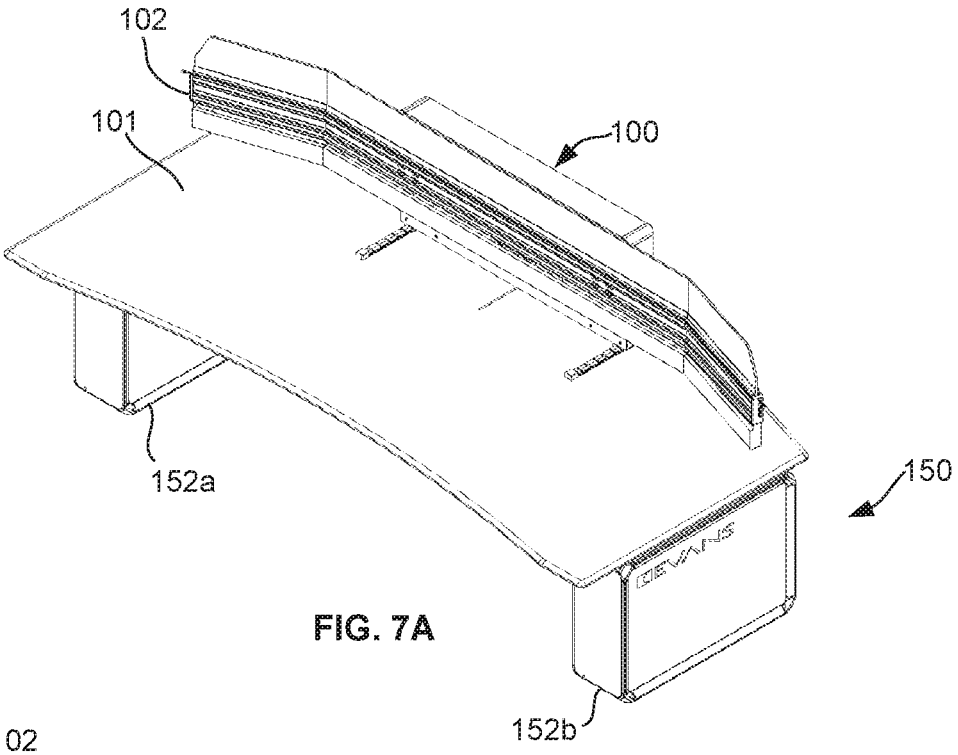
FIGS. 7A and 7B are front perspective and rear perspective views of an example console with the apparatus of FIGS. 1 to 6 mounted thereon.
Figure 7B:
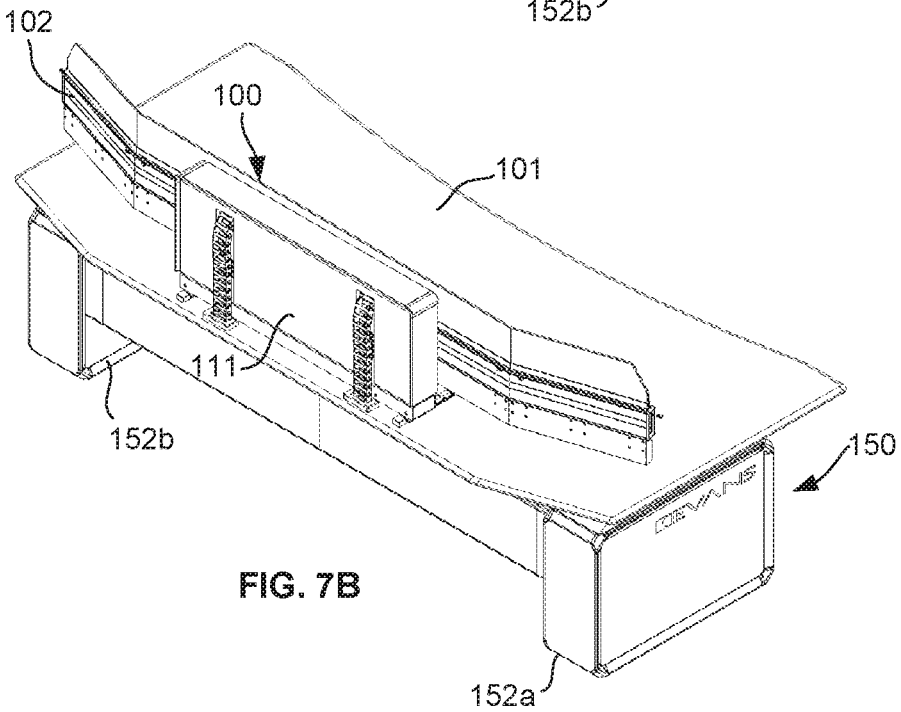
Figure 8:
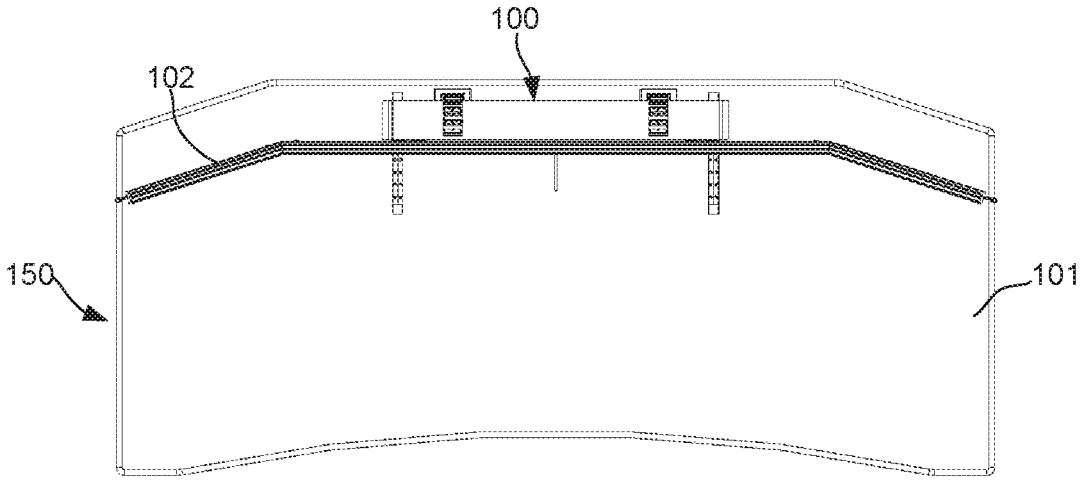
FIG. 8 is a top view of the console and apparatus of FIGS. 7A and 7B.
Figure 9:
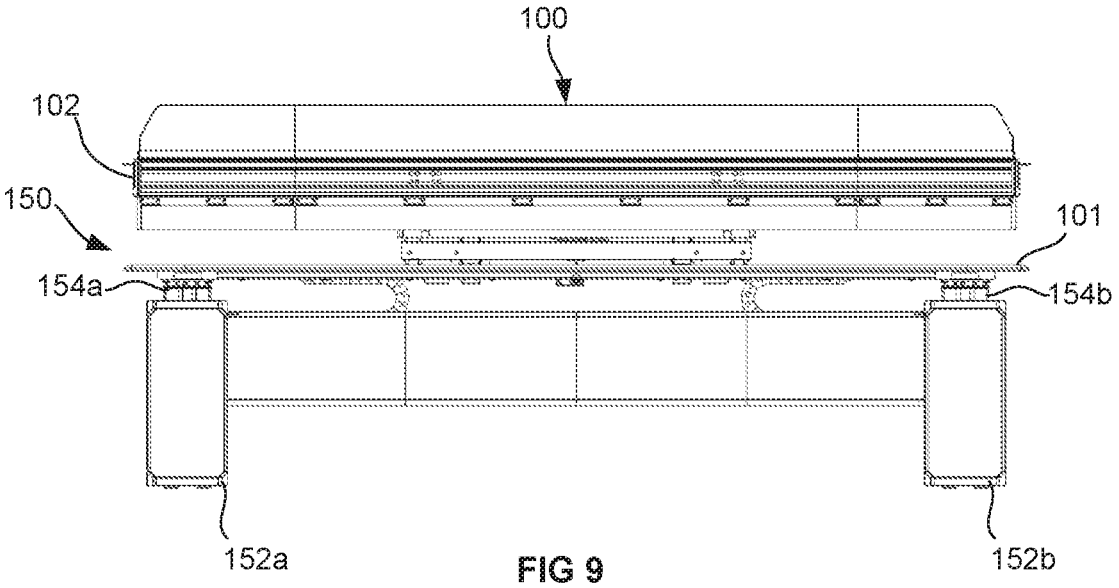
FIG. 9 is a front view of the console and apparatus of FIGS. 7A to 8.
Figure 10:
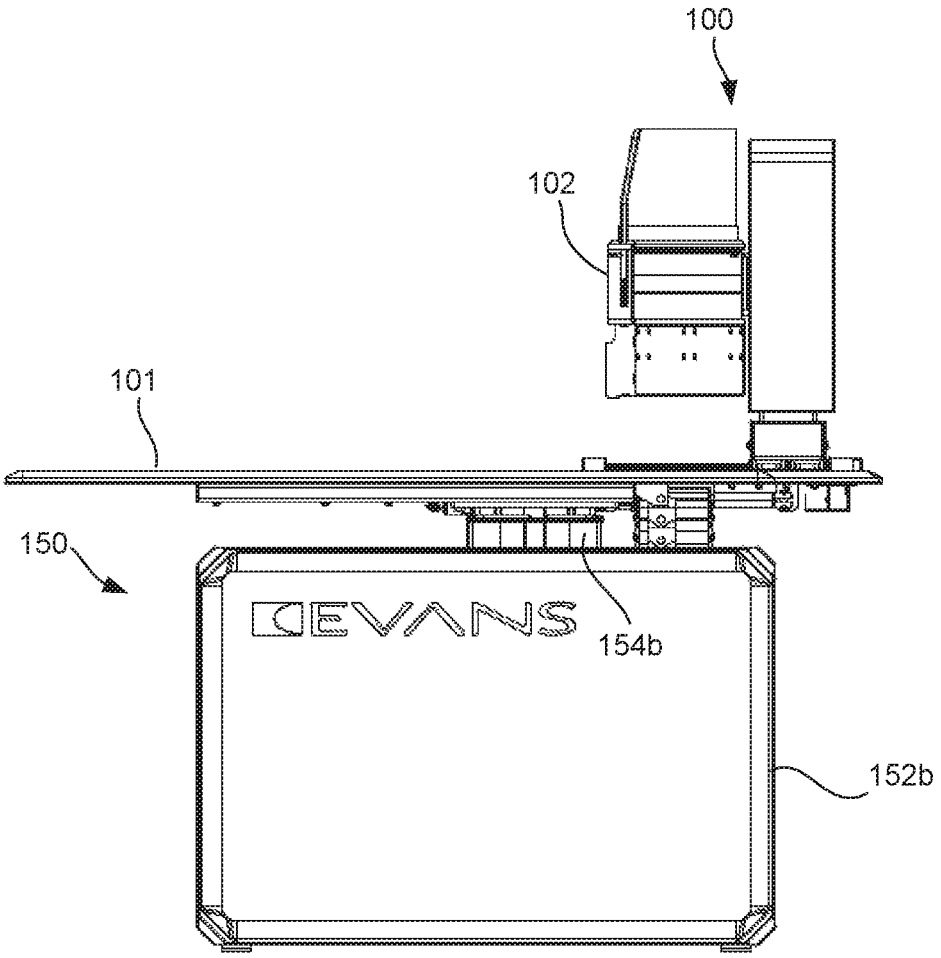
FIG. 10 is a side view of the console and apparatus of FIGS. 7A to 9.

FIGS. 7A and 7B are front perspective and rear perspective views of an example console 150, which includes the work surface 101, with the apparatus 100 mounted thereon, according to one embodiment. FIGS. 8 to 10 are top, front and side views of the console 150 with the apparatus 100 mounted on the work surface 101.

In the example of FIGS. 7A to 10, the work surface 101 of the console 150 is itself vertically adjustable. More specifically, leg structures 152*a* and 152*b* of the console 150 include vertical lifts 154*a* and 154*b* respectively (shown in FIGS. 9 and 10), and the work surface 101 is mounted on the vertical lifts 152*a* and 152*b*.

The apparatus 100 may include or be operably connected to one or more controllers (not shown) that control the vertical and/or horizontal position of the equipment mounting structure 102 and/or the height of the work surface 101. For example, the one or more controllers may be coupled to the vertical lifts 154*a* and 154*b* of the console. The vertical position of the equipment mounting structure 102 may be synchronized or otherwise be set as a function of the height of the work surface 101. For example the work surface 101 may be set at a first height for a sitting configuration and a second height for a standing configuration. The apparatus 100 may automatically adjust the vertical position of the equipment mounting structure 102 (relative to the work surface) for the sitting and standing configurations. The one or more controllers may include a user input (e.g. one or more buttons), one or more processors and/or one or more memories coupled to the one or more processors. Any suitable method for controlling the apparatus 100 and/or lifts 154*a* and 154*b* of the console 150 may be used.

As will be appreciated, the horizontal and vertical movement of the apparatus 100 is optional. The horizontal and/or vertical adjustment mechanism may also be omitted in some embodiments. The movement may be powered (e.g. motor-driven) and/or manual.

In another aspect of the disclosure, an apparatus for mounting equipment for use with a console (or other furniture) is provided, where the apparatus is situated generally behind the console, and the rear is opposite to the front. For example, the apparatus may sit on the floor or ground surface and may be secured to the console. In some embodiments, the apparatus is secured to one or more leg structures of the console.

Figure 11:
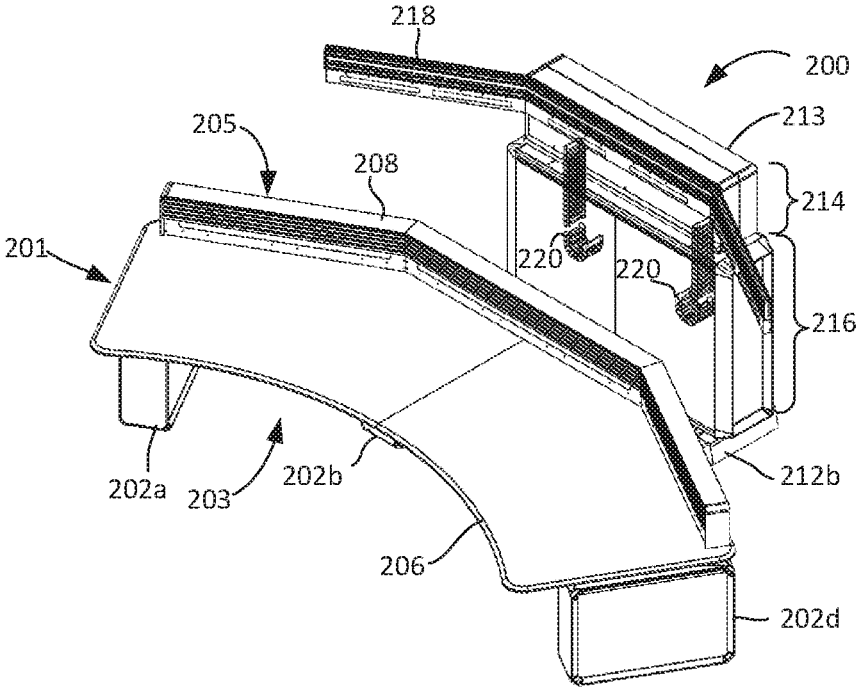
FIG. 11 is a front perspective view of an equipment mounting apparatus according to another embodiment attached to an example console.
Figure 12:
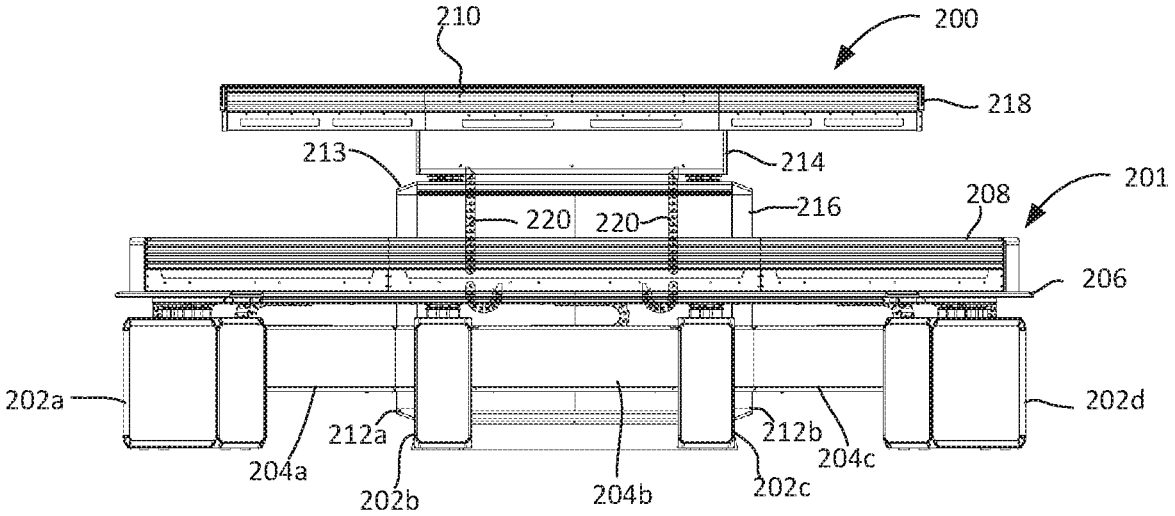
FIG. 12 is a front perspective view of the equipment mounting apparatus and console of FIG. 11.

FIG. 11 is a perspective view an equipment mounting apparatus 200, according to another embodiment, attached to example console 201. FIG. 12 is a front view of the apparatus 200 and console 201. The console 201 is shown simply by way of example. It is to be understood that the apparatus 200 may be used with other types of consoles. The apparatus 200 again provides for both vertical and horizontal adjustment with respect to a console, as will be explained below. For ease of description, the console 201 is defined herein with a front 203 and a rear 205.

The example console 201 comprises first, second, third and fourth leg structures 202*a*, 202*b*, 202*c* and 202*d*. First, second and third lateral support structures 204*a*, 204*b* and 204*c* interconnect that first, second, third and fourth leg structures 202*a*, 202*b*, 202*c* and 202*d*. The first, second, third and fourth leg structures 202*a*, 202*b*, 202*c* and 202*d* are vertically adjustable (including lifts) and support work surface 206 thereon. A forward-facing slat rail 208 for supporting one or more displays and/or other equipment (not shown) is mounted on the work surface 206. Displays mounted to the slat rail 208 may be referred to as "primary" displays herein.

In this example, the apparatus 200 is positioned behind the console 201 and is attached to the second and third leg structures 202*b* and 202*c* of the console. The apparatus 200 in this example embodiment includes two feet 212*a* and 212*b* which are connected to the second and third leg structures 202*b* and 202*c* of the console 201 respectively. The apparatus 200 comprises a support assembly including an upper body section 214 and a lower body section 216, with the upper body section 214 mounted over the lower body section 216. In this example, the lower body section 216 is a first support structure and the upper body section 214 is a second support structure. The lower body section 216 (first support structure) is connected to the horizontal adjustment mechanism (first and second guiderails 217*a* and 217*b*) and the vertical adjustment mechanism (vertical lifts 302*a* and 302*b*) interconnects the lower body section 216 (first support structure) and the upper body section 214 (second support structure).

Figure 15:
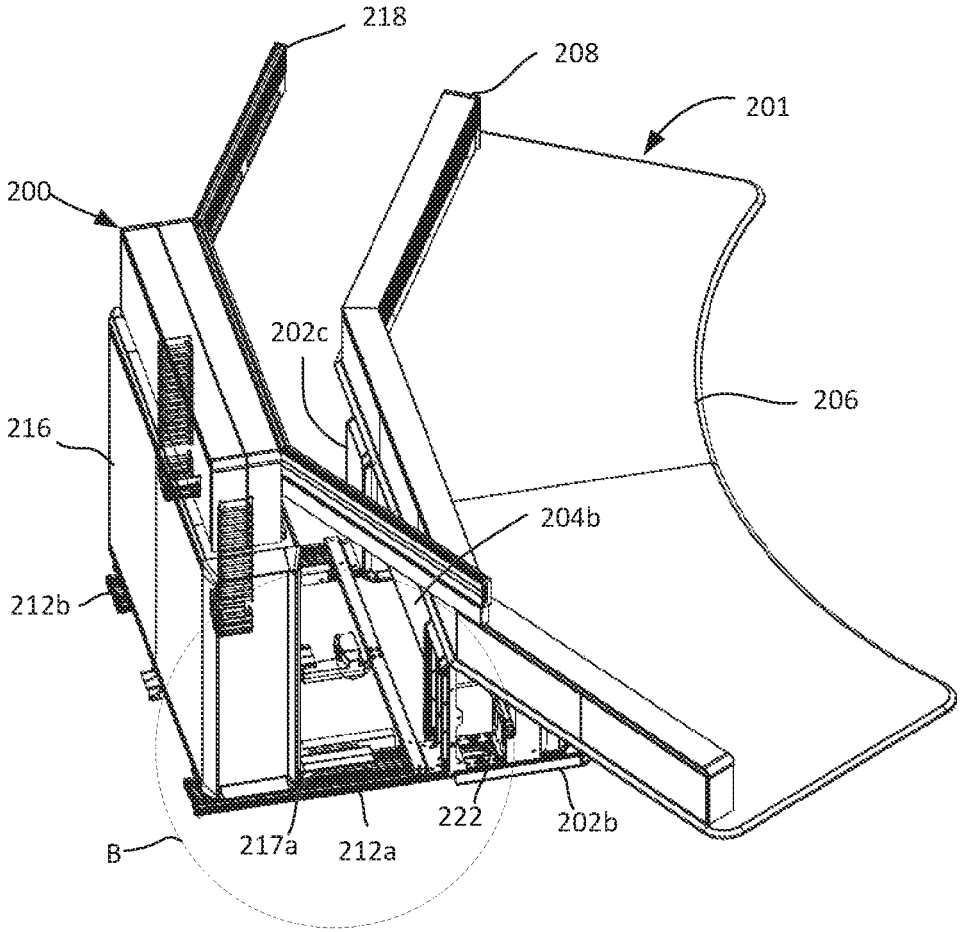
FIG. 15 is a rear perspective view of the apparatus and console of FIGS. 11 and 12.
Figure 23:
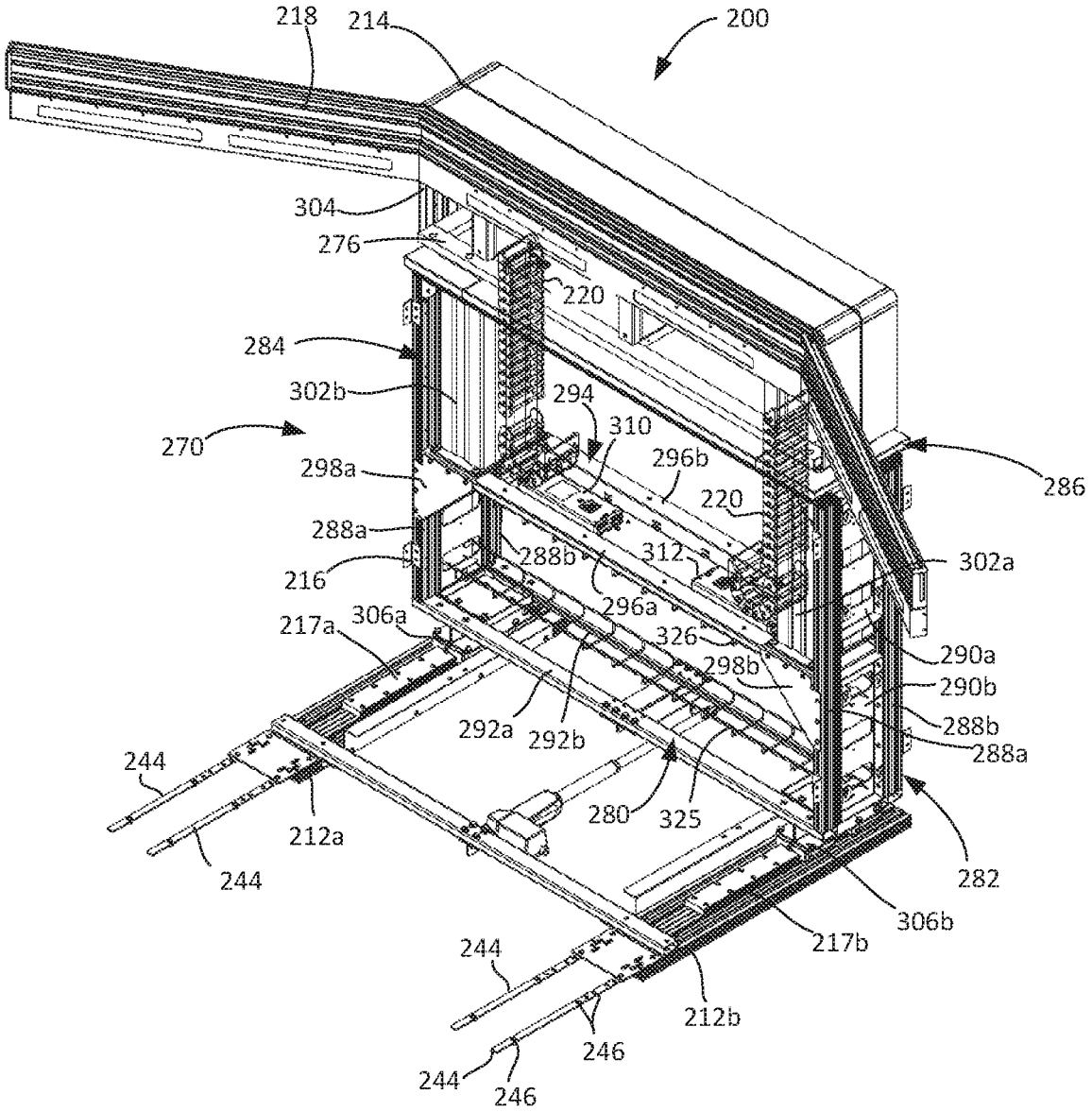
FIG. 23 is a front perspective view of the apparatus of FIGS. 17 to 22 showing an example frame structure of the apparatus.

The lower body section 216 is slidably connected to the first and second feet 212*a* and 212*b* by first and second guiderails 217*a* and 217*b* respectively (shown in FIGS. 15 and 23).

The apparatus 200 also includes a slat rail 218, mounted to the upper body section 214. Other equipment mounting structures may be used, and embodiments are not limited to slat rails. Additional displays (which may be referred to herein as "secondary displays") and/or other equipment may be mounted to the slat rail 218. The upper body section 214 is vertically adjustable with respect to the lower body section 216 in this embodiment via first and second vertical lifts 302*a* and 302*b* (best shown in FIGS. 23 to 25B) that interconnect the upper and lower body sections 214 and 216, as will be described in more detail below.

The console 201 may include a controller (not shown) that controls the motors driving the vertically adjustable supports. The controller may include one or more buttons, control panels, or other input means coupled to one or more motors that drive the vertical lifts 302*a* and 302*b*. Such motors and/or controllers may be housed in the main body 213 or the console 201, for example. The upper and lower body sections 214 and 216 may also provide storage space therein for a variety of other equipment such as cables, outlets, electronics, etc. The controller may also control horizontal movement via the guiderails 217*a* and 217*b* (FIGS. 15 and 23).

Optional cable management chains 220 between the upper and lower body sections 214 and 216 are shown in FIGS. 11 and 12. The cable management chains 220 provide a cable pathway between the interior of the upper body section 214 and the interior of the lower body section 216. The cable management chains 220 will be at least partially contained within the main body 213 and thus partially hidden from view. However, in FIGS. 11 and 12 the chains 220 are shown as visible through the main body 213 for illustrative purposes.

Figure 13:
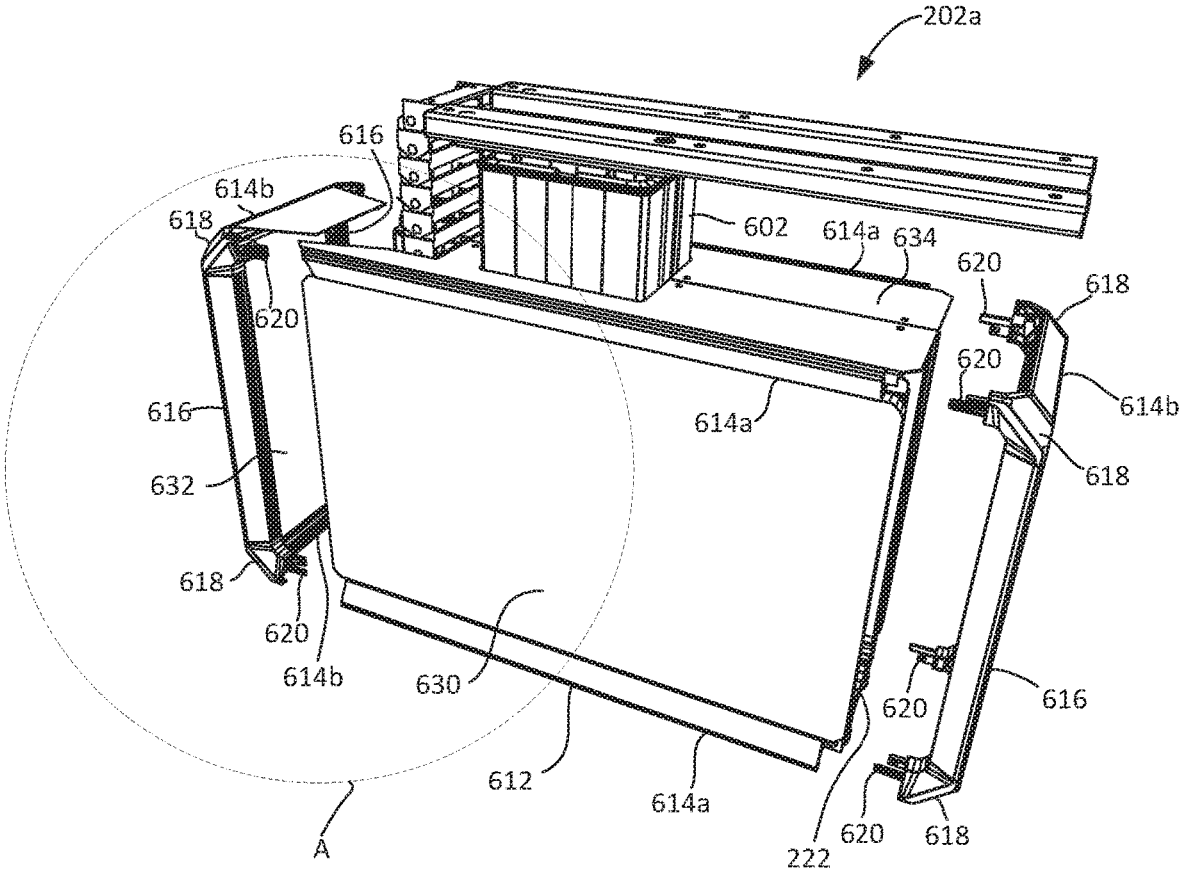
FIG. 13 is a partially exploded perspective view of a leg structure of the example console of FIGS. 11 and 12.

The form and structure of the example leg structures 202*a* to 202*d* of the console 201 will now be described in more detail with reference to FIGS. 13 and 14. FIG. 13 is a partially exploded perspective view of the first leg structure 202*a*. The second, third and fourth leg structures 202*b*, 202*c* and 202*d* have similar structures. The leg structure 202*a* in FIG. 13 includes a base 222 and a vertically adjustable lift 602 mounted on the base. The lift 602 supports the work surface 206 of the console 201 (shown in FIGS. 11 and 12).

Figure 14:
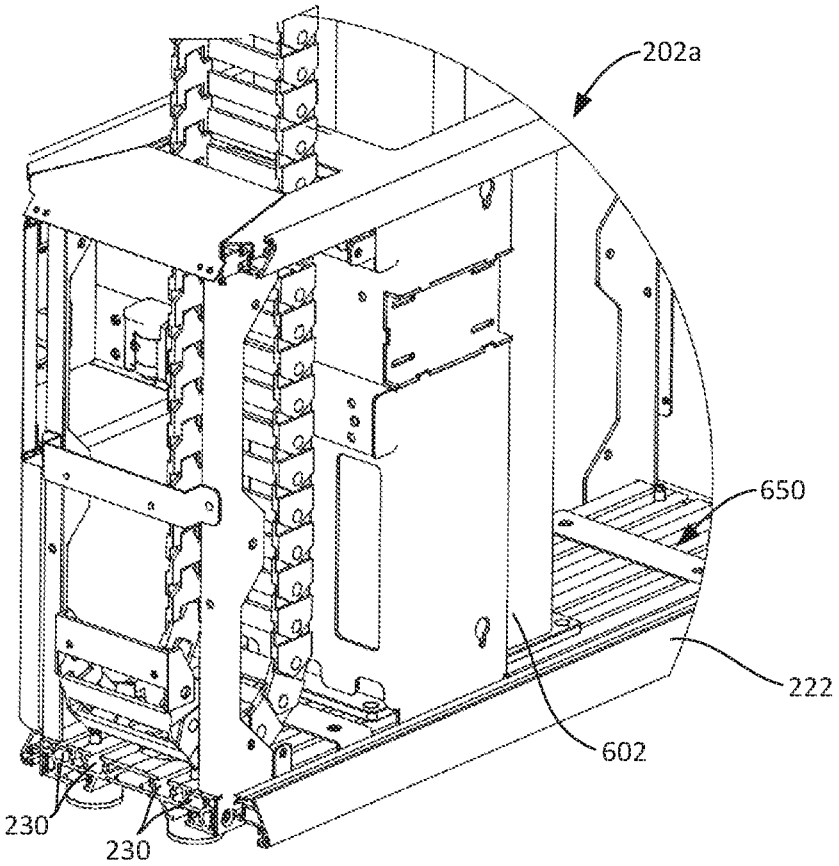
FIG. 14 is an enlarged view of the portion of the leg structure within circle "A" in FIG. 13.

As shown in FIG. 13, the first leg structure 202*a* includes a housing 612 that substantially encloses the base 222 and the lift 602 (shown in FIG. 14). The base 222 in this example is an extrusion having elongated, upward facing ports 230 (shown in FIG. 14) along its length for receiving fastening hardware. The housing 612 comprises lengthwise horizontal extrusions 614*a*, transverse horizontal extrusions 614*b*, and vertical extrusions 616, which are connected by corner castings 618. The horizontal extrusions 614*a* and 614*b*, the vertical extrusions 616 and the corner castings 618 form a rectangular prism shaped frame for the housing 612. The example corner castings 618 may connect to the horizontal and vertical extrusions 614*a*, 614*b*, 616 in any suitable manner. In the example of FIG. 13, optional corner castings 618 include optional tongues 620 that are inserted into ends of the corresponding horizontal and vertical extrusions 614*a*, 614*b*, 616 and guide the castings 618 into place. The tongues 620 may, for example, include attachment means to hold the castings 618 in place when connected to the horizontal extrusions 614*a* and 614*b* and the vertical extrusions 616. The example housing frame (including extrusions 614*a*, 614*b*, 616 and corner castings 618) holds a front panel (not visible in FIG. 13), side panel 630, rear panel 632 and top panel 634. Embodiments are not limited to the particular housing frame structure of the corner castings 618 and horizontal and vertical extrusions 614*a*, 614*b*, 616 shown.

FIG. 14 is an enlarged partial view of the portion of the leg structure 202*a* within circle "A" in FIG. 13. The panels 630 and 632 (shown in FIG. 13) are removed so that the inner components of the leg structure 202*a* are visible. As shown, the base 222 in this example is an elongated extrusion with a generally flat upper face 650. The base 222 defines elongated ports 230 along the length of the upper face 650. The ports are for receiving fastening hardware at selectable, variable positions along their length. Thus, for example, the lift 602 may be mounted at various positions on the base 222.

FIG. 15 is a rear perspective view of the apparatus 200 and console 201 of FIGS. 11 and 12. In FIG. 15, the first and fourth leg structures 202*a* and 202*d* and the first and third lateral support structures 204*a* and 204*c* (see FIG. 13) are removed to provide a better view of the connections between the apparatus 200 and the second and third leg structures 202*b* and 202*c*. Outer coverings of the first and second feet 212*a* and 212*b* and the panels 630 and 632 (shown in FIG. 13) of the second leg structure 202*b* are also removed in FIG. 15. As shown, the first foot 212*a* of the apparatus 200 connects to the base 222 of the second leg structure 202*b*, and the second foot 212*b* of the apparatus 200 connects to a corresponding base of the third leg structure 202*c*.

Figure 16A:
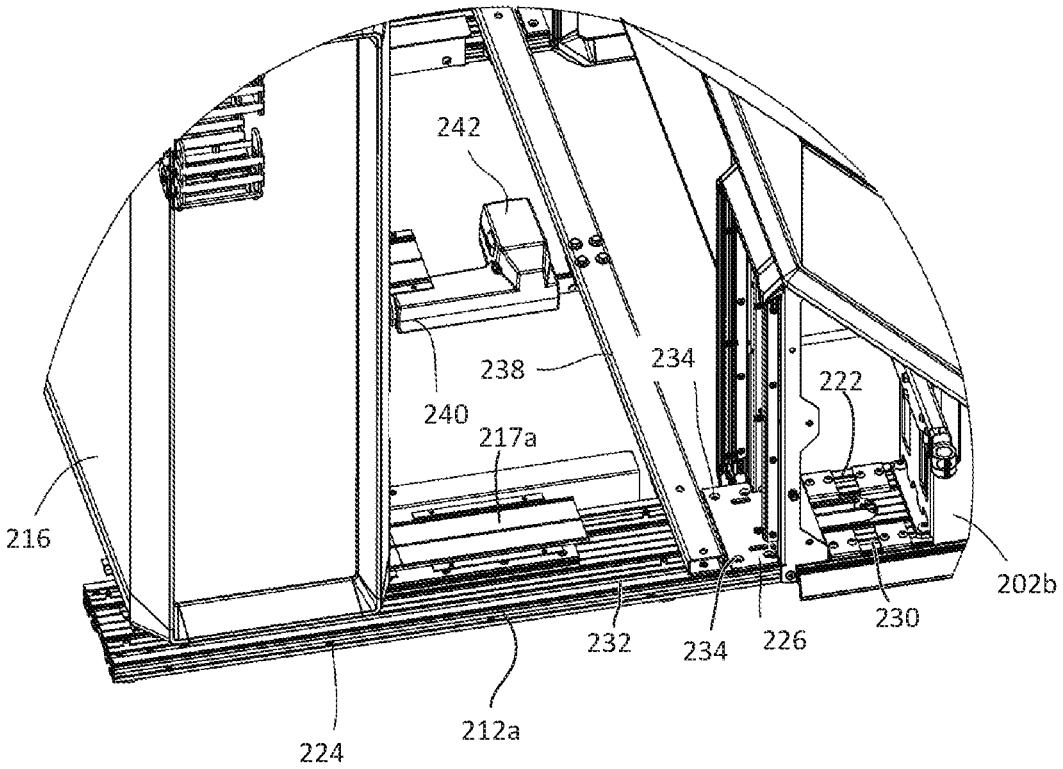
FIG. 16A is an enlarged view of the portion of the apparatus and console within circle "B" in FIG. 15.

FIG. 16A is an enlarged view of the portion of the console 201 within circle "B" in FIG. 15. As shown, the first foot 212*a* of the apparatus 200 includes an extrusion base 224 with a profile similar to the base 222 of the second leg structure 202*b*. The base 224 of the first foot 212*a* abuts the base 222 of the second leg structure 202*b*. The base 222 of the leg structure defines elongated ports 230 for receiving fastening hardware that are aligned with and abut similar elongated ports 232 of the base 224 of the first foot 212*a*. A splining plate 226 partially overlies the base 224 and the base 222. Connection strips 244 with threaded holes 246 (shown in FIGS. 16B and 23) may be inserted in the corresponding ports 230 and 232. At least some of the holes 246 of the strips are aligned with holes 234 of the splining plate 226, such that fastening hardware (not shown) can secure the splining plate to both the second leg structure 202*b* and the first foot 212*a*.

As also shown in FIG. 16A, the first foot 212*a* includes a horizontal guiderail 217*a* on which the lower body section 216 of the apparatus 200 is mounted. The second foot 212*b* includes a similar guiderail 217*b*. The lower body section 216 of the apparatus 200 is slidably mounted on the guiderails 217*a* and 217*b* (FIG. 23) of the first foot 212*a* and the second foot 212*b* to allow forward and backward movement. In this example, a cross beam 238 is mounted between the first and second feet 212*a* and 212*b*, and a horizontally-aligned and telescoping actuator 240 interconnects the lower body section 216 and the cross beam 238. A motor 242 drives the horizontal actuator 240. A controller (not shown) may be included to control the motor 242 and thereby control the horizontal position of the apparatus 200.

Figure 16B:
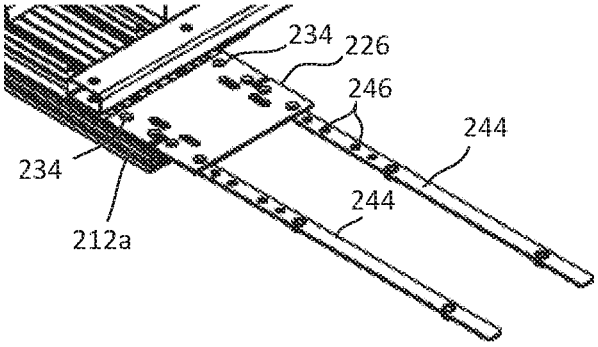
FIG. 16B is a further enlarged partial view of the foot of the apparatus from FIG. 16A and shows example hardware for connecting the equipment mounting apparatus to the console.

FIG. 16B is a further enlarged partial view of the foot 212*a* from FIG. 16A. FIG. 16B shows the splining plate 226 unconnected from the leg 202*b* of FIG. 16A. FIG. 16B also shows the strips 244 with the threaded holes 246 that are inserted into the ports 230 and 232 of the base 222 of the console leg 202*b*.

The method of connecting the apparatus to the console may vary. For example, in other embodiments, an apparatus for mounting equipment may comprise a hook, clip or any other suitable fastening means to secure the apparatus to a console. In still other embodiments, the apparatus may simply be put in place (e.g. rolled on wheels) near the console, but not be physically secured to the console. Electrical power and/or data connections between components of the apparatus and the console may be made using cables, wireless transmissions, or any other suitable means.

As explained above, the horizontal and vertical position of the slat rail 218 may be adjusted. The vertical adjustment is described below with reference to FIGS. 23 to 25. It is to be understood that the vertical and horizontal movement of the apparatus 200 is optional and may be manual or automatic. The apparatus 200 may also be static (omitting vertical and/or horizontal adjustment components) in other embodiments.

Figure 17:
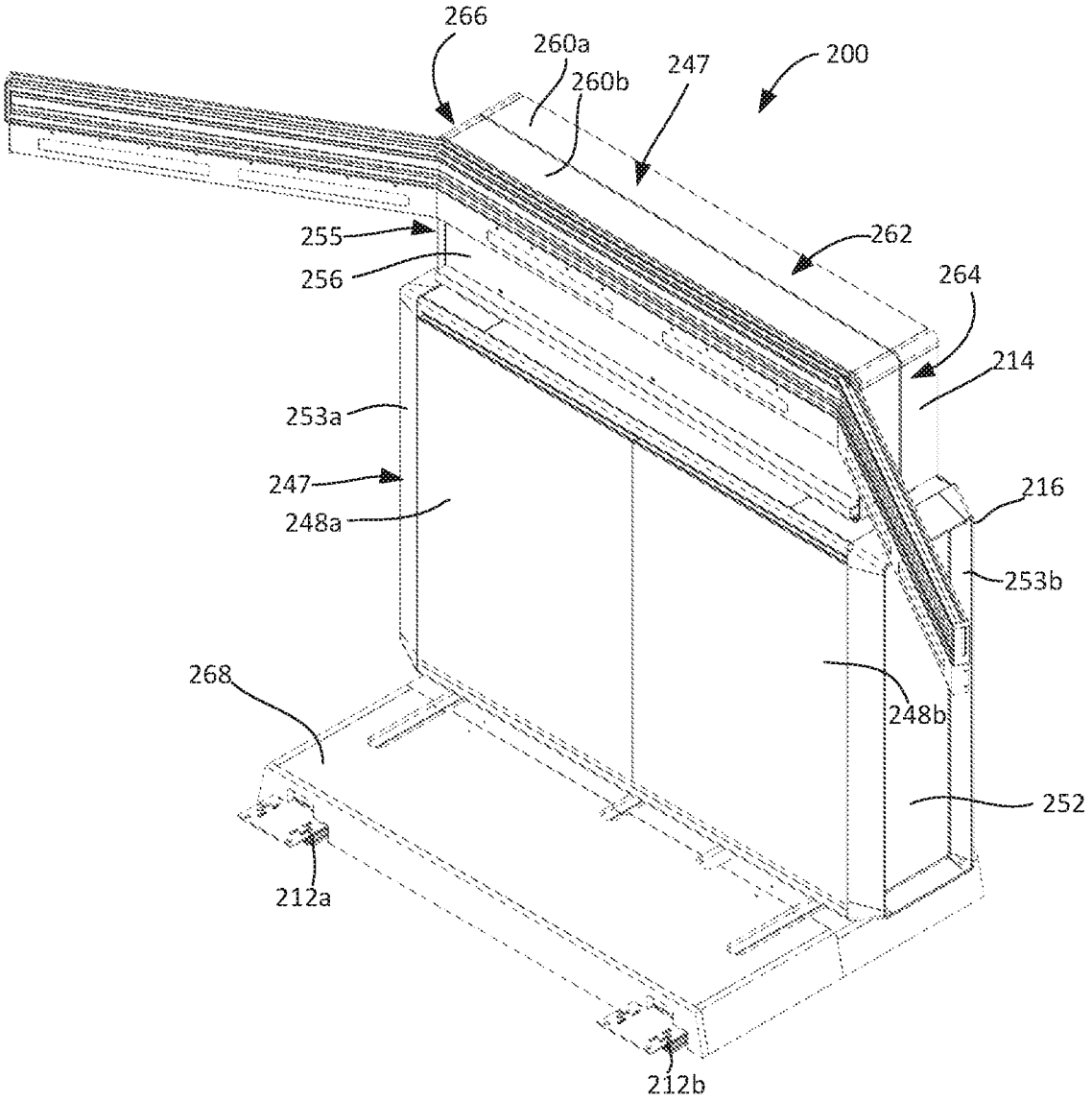
FIG. 17 is a front perspective view of the equipment mounting apparatus of FIGS. 11 and 12.
Figure 18:
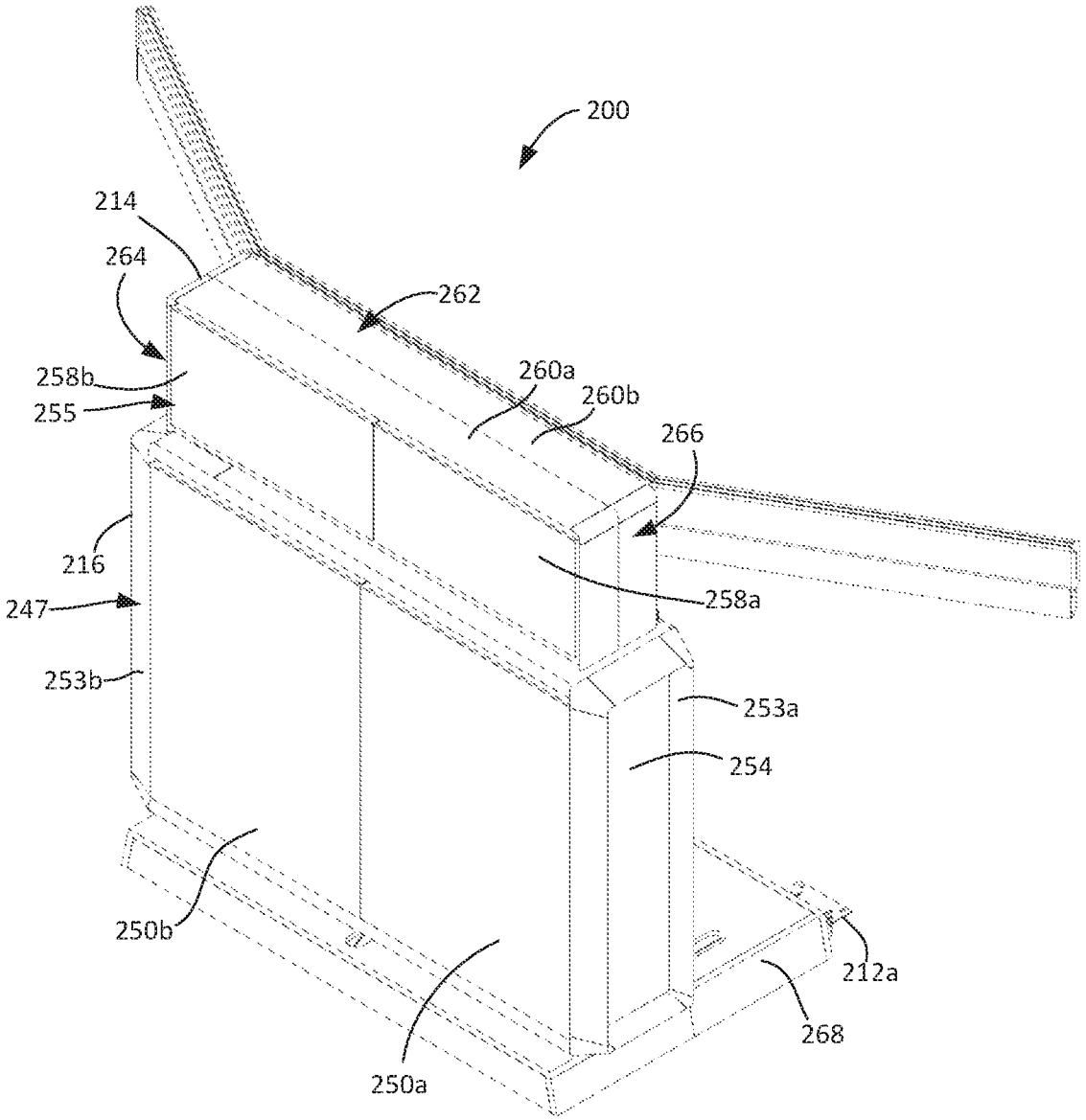
FIG. 18 is a rear perspective view of the equipment mounting apparatus of FIG. 17.
Figure 19:
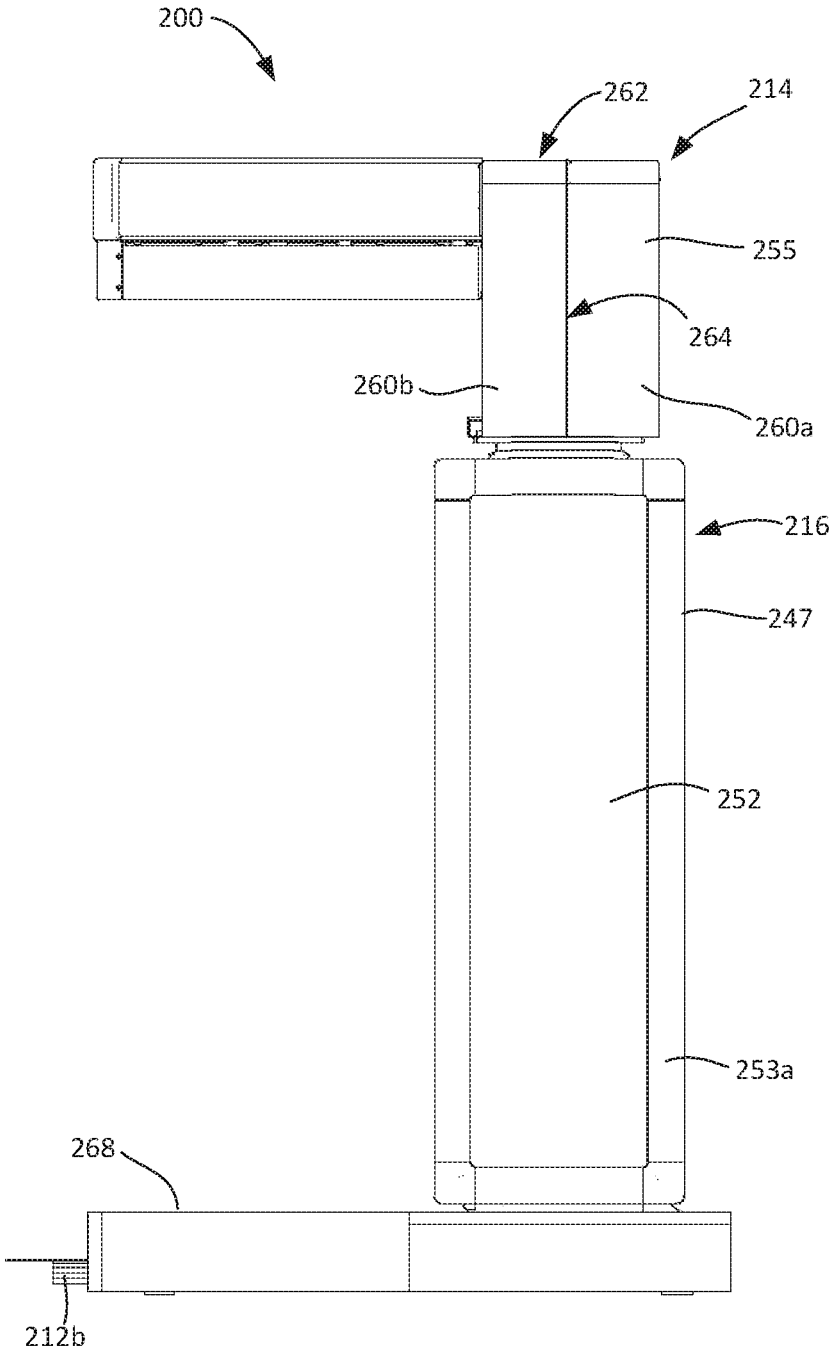
FIG. 19 is a side view of the apparatus of FIGS. 17 and 18.
Figure 20:
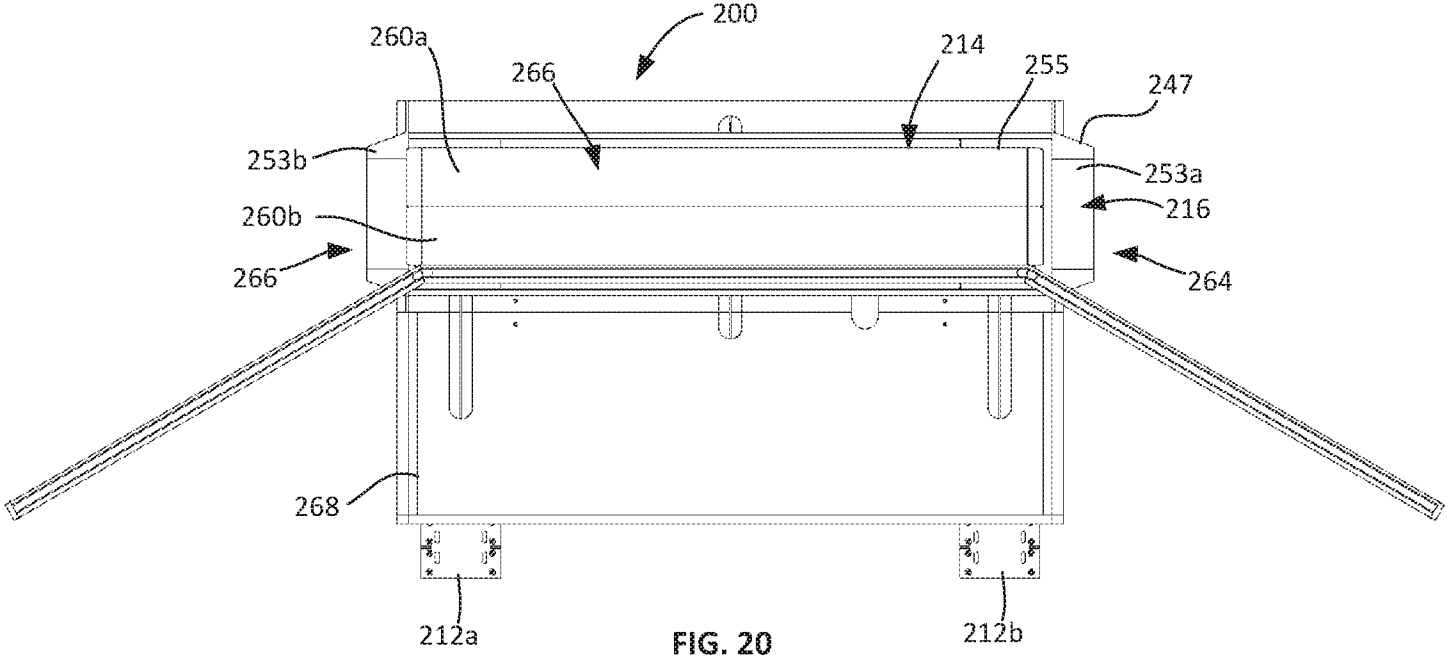
FIG. 20 is a top view of the apparatus of FIGS. 17 to 19.
Figure 21:
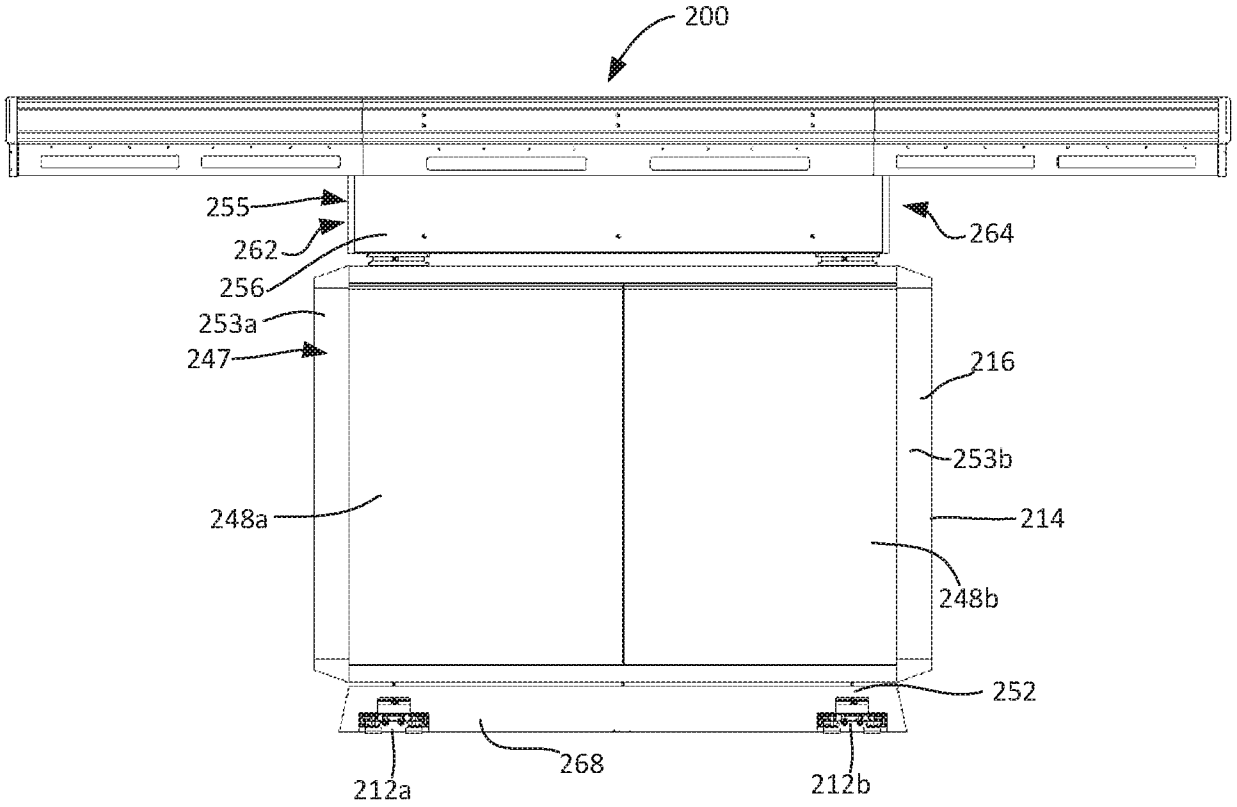
FIG. 21 is a front view of the apparatus of FIGS. 17 to 20.

FIGS. 17 and 18 are front and rear perspective views respectively of the apparatus 200. FIGS. 19 to 21 are side, top and front views respectively of the apparatus 200. As shown in FIGS. 17 to 21, the lower body section 216 has an outer housing 247 comprising front covers 248*a* and 248*b* (FIGS. 17 and 20), back covers 250*a* and 250*b* (FIG. 18), a first side cover 252 (FIGS. 17 and 19), a second side cover 254 (FIG. 18) and trim 253*a* and 253*b*. The upper body section 214 has an outer housing 255 that comprises front cover 256 (FIG. 17), back covers 258*a* and 258*b* (FIG. 18) and strip covers or trim 260*a* and 260*b* that extend the top 262 and sides 264 and 266 of the upper body section 214. An additional housing 268 is also shown that substantially covers the first and second feet 212*a* and 212*b* (FIG. 18) are also included. The back covers 250*a* and 250*b* of the lower body section 216 and the back covers 258*a* and 258*b* of the upper body section 214 are removable in this example to provide access to the respective interiors. In other embodiments, one or more doors or other openings may be included. The housings 247, 255 and 268 may also include additional structural elements or omit one or more elements described above. However, it is to be understood that such housings may also be omitted in other embodiments, and embodiments are not limited to any particular housing configuration.

Figure 22:
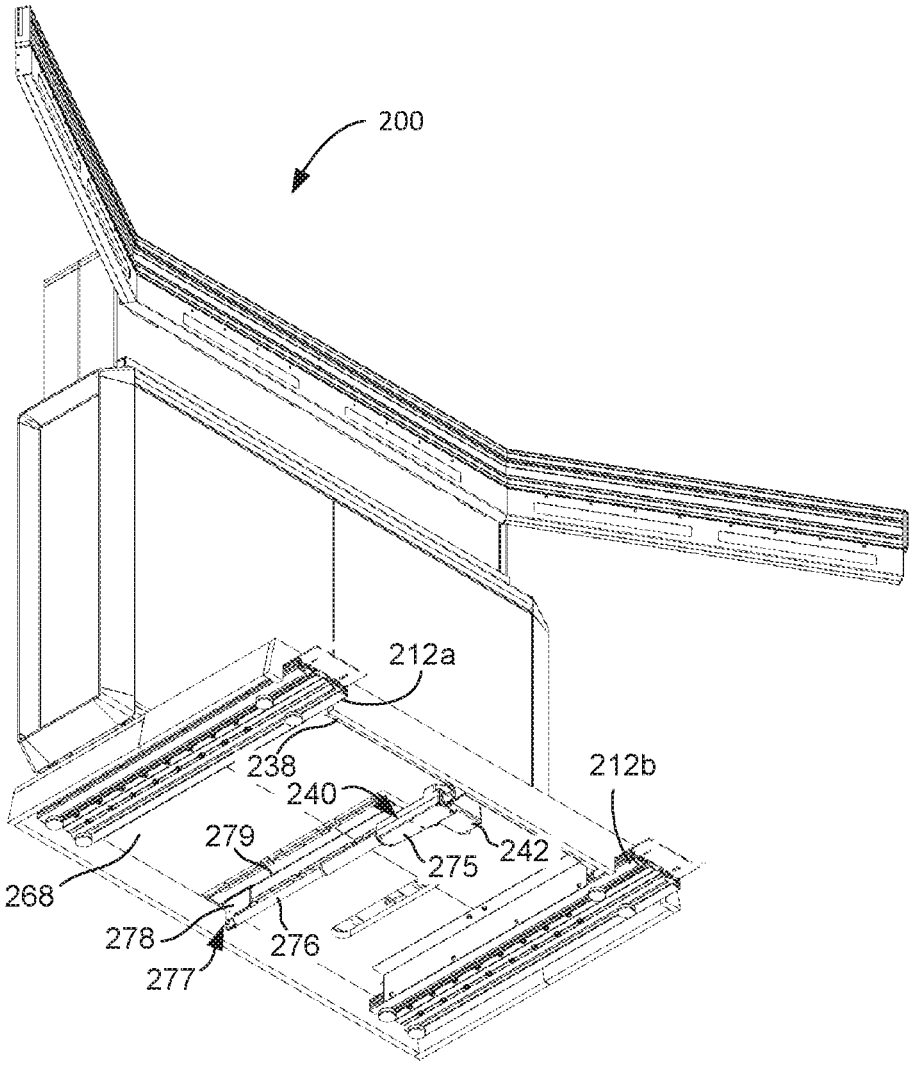
FIG. 22 is a bottom perspective view of the apparatus of FIGS. 17 to 21.

FIG. 22 is a bottom perspective view of the apparatus 200 that illustrates how actuation of the guiderails 217*a* and 217*b* is accomplished in this embodiment. In addition to the guiderails 217*a* and 217*b*, the horizontal adjustment mechanism in this embodiment includes the horizontally aligned and telescoping actuator 240. The actuator 240 includes a base 275 and a telescoping rod 276 coupled to the base 275. The base 275 is fastened to the cross beam 238. A distal end 277 of the telescoping rod 276 is attached to a bracket 278. The bracket extends upward through a slot 279 in the housing 268 over the feet 212*a* and 212*b* and attaches to a crossbeam 292*b* (shown in FIG. 23) of the lower body portion 214. The slot 279 provides clearance for forward/backward horizontal movement of the bracket 278. The motor 242 drives the extending or contracting movement of the telescoping rod 276, thereby causing the lower body portion 214 to move horizontally over the guide rails 217*a* and 217*b*.

Figure 24:
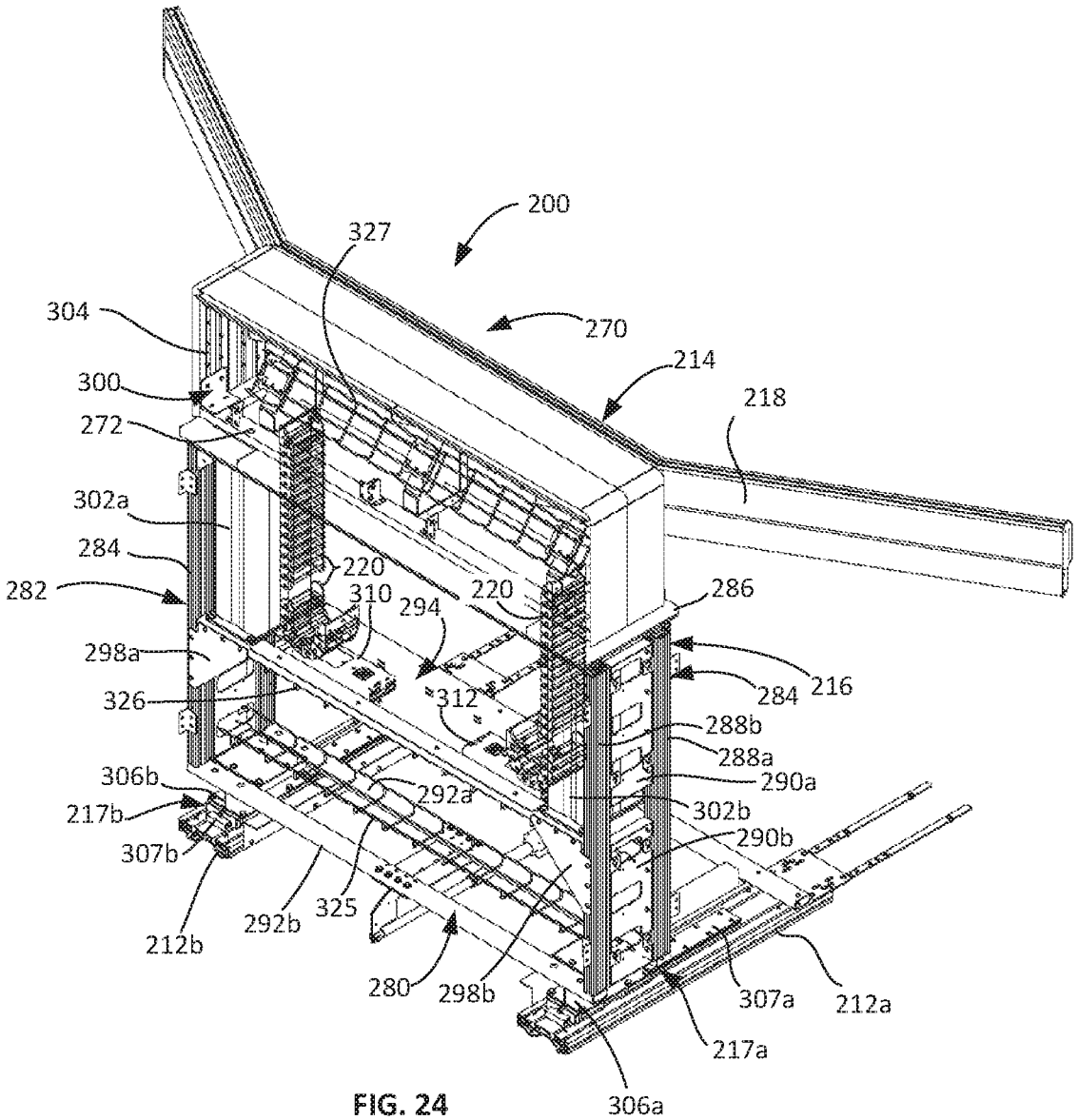
FIG. 24 is a rear perspective view of the apparatus of FIG. 23.

FIGS. 23 and 24 are front and rear perspective views of the apparatus 200 with the housings 247 and 268 (FIGS. 17 and 18) of the lower body section 216 and feet 212*a* and 212*b*, and the back panels 258*a* and 258*b* of the housing 255 of the upper section (FIG. 18), removed.

The lower body section 216 of the apparatus 200 includes a lower frame section 280, first and second side frame sections 282 and 284 and a top frame section 286, which are connected to form a box-like frame configuration. More specifically, the first and second side frame sections 282 and 284 are connected between the top and lower frame sections 280 and 286.

The side frame sections 282 and 284 have the same, but mirrored, structure in this embodiment. Each of the side frame sections 282 and 284 includes a respective pair of first and second spaced apart vertical beams 288*a* and 288*b* with panel frames 290*a* and 290*b* connected therebetween. The first vertical beam 288*a* is positioned in front of the second vertical beam 288*b*.

The lower frame section 280 includes horizontally spaced apart first and second lower cross beams 292*a* and 292*b*. The lower body section 216 of the apparatus 200 also includes an intermediate horizontal frame section 294 positioned between the lower frame section 280 and the top frame section 286. The intermediate frame section 294 includes first and second intermediate cross beams 296*a* and 296*b* (FIG. 23). First and second right-angle support brackets 298*a* and 298*b* support and connect the intermediate cross beams 296*a* and 296*b* to the vertical beams 288*a* and 288*b* of the side frame sections 282 and 284.

First and second, telescoping vertical lifts 302*a* and 302*b* are mounted to the intermediate frame section 294 over the first and second right-angle support brackets 298*a* and 298*b*. The lifts each protrude upward through an opening (not visible) in the upper frame section 286 of the lower body section 216. The The upper body section 214 of the apparatus includes a box-like frame 304 to which the slat rail 218 is mounted. The frame 300 of the upper body section 214 includes a lower frame section 272 that is mounted to and supported by the vertical lifts 302*a* and 302*b*. Thus, by raising (extending) or lowering (contracting) the vertical lifts 302*a* and 302*b*, the upper body section 214 of the apparatus may be raised or lowered, thereby providing vertical movement of the slat rail 218.

Cable management chains 220 are visible in FIGS. 23 and 24. These chains 220 are shown partially exploded (with a break in one section) for illustrative purposes. However, the cable management chains 220 will typically each comprise a continuous, unbroken length. However, such cable management means is optional.

As also shown in FIGS. 23 and 24, the guiderail 217*a* comprises a guiderail block 306*a* slidably mounted to a rail 307*a* to allow horizontal movement of the block 306*a* along the length of the rail 307*a*. The block 306*a* is attached to the bottom of the lower body section 216 of the apparatus 200. The rail 307*a* is mounted to the corresponding foot 212*a*. The second guiderail 217*b* similarly comprises a respective guiderail block 306*b* and rail 307*b*, similarly connecting the lower body section 216 to the other foot 212*b*. Embodiments are not limited to the particular guiderails 217*a* and 217*b* shown in FIGS. 23 and 24. Other types of guiderails, or different horizontal adjustment mechanisms, may be used in other embodiments.

Figure 25A:
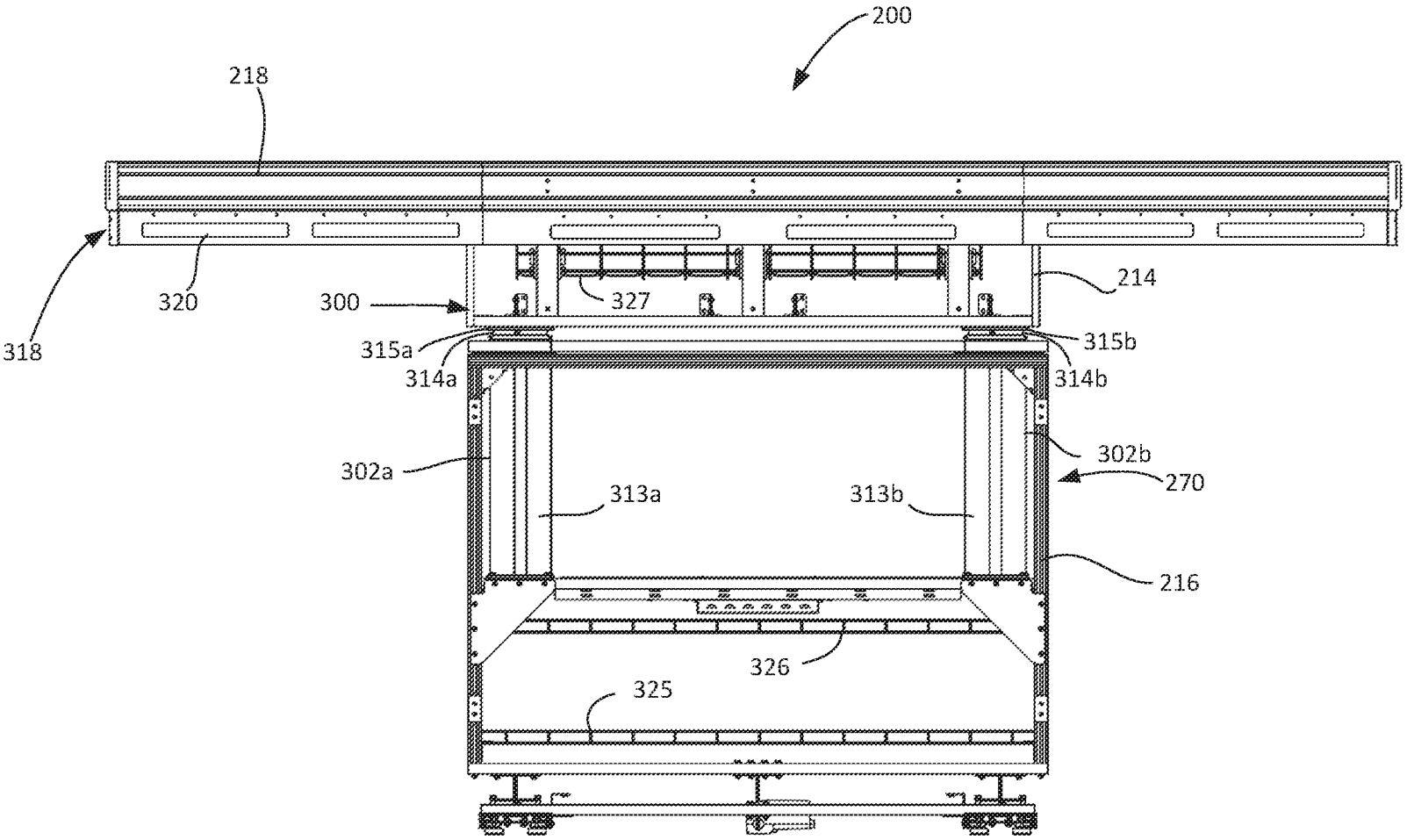
FIG. 25A is a front view of the apparatus of FIGS. 23 and 24, with vertical lifts in a contracted, lowered position.
Figure 25B:
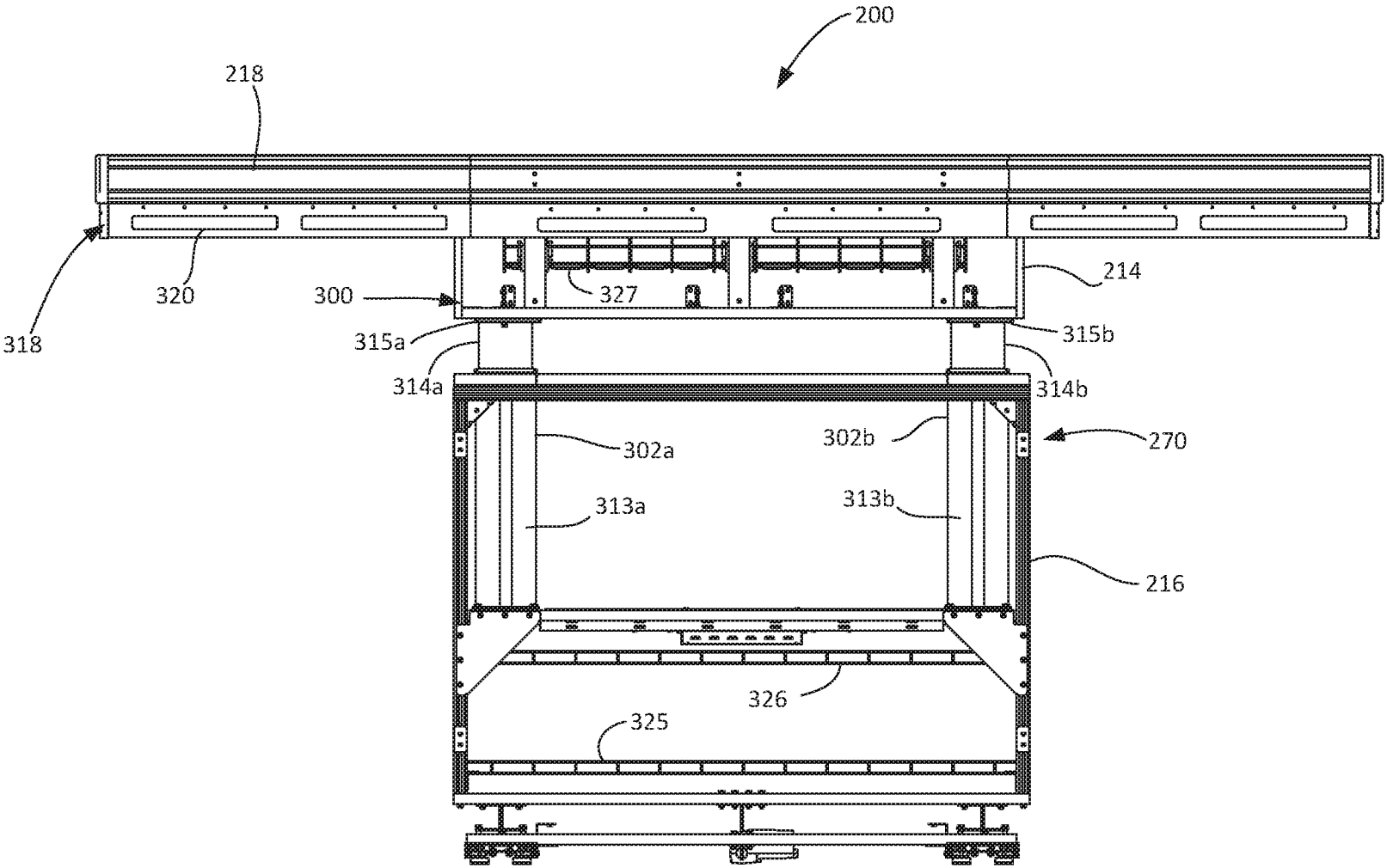
FIG. 25B is a front view of the apparatus of FIGS. 23 and 24, with vertical lifts in an extended, raised position.

FIGS. 25A and 25B are a rear views of the apparatus with the at least part of the housings 247, 255 and 268 (FIGS. 17 to 21) removed so that the frame structure described below is visible. In FIG. 25A, the vertical lifts 302*a* and 302*b* are in a contracted position. In FIG. 25B, the vertical lifts 302*a* and 302*b* are in an extended position. As shown in FIGS. 25A and 25B, the vertical lifts 302*a* and 302*b* each include: a respective upper main body 313*a* or 313*b*; a vertically telescoping support beam 314*a* or 314*b*, which extends out from and telescopes with the main body 313*a* or 313*b*. Each support beam 314*a* or 314*b* has an upper support plate 315*a* or 315*b* at an upper/distal end thereof. The frame 300 of the upper body section 214 of the apparatus 200 is mounted on the support plates 315*a* and 315*b* of the vertical lifts 302*a* and 302*b*. Embodiments are not limited to the particular vertical lifts 302*a* and 302*b* shown in FIGS. 25A and 25B. Other types of lifts, or different vertical adjustment mechanisms, may be used in other embodiments.

The first vertical lifts 302*a* and 302*b* in this example are powered. Any type of suitable motor, or pneumatic mechanism may be used, for example. First and second controllers 310 and 312 shown in FIGS. 23 and 24 control the first and second vertical lifts respectively. In other embodiments, a single controller may control both lifts. The first and second lift controllers 310 and 312 may typically both be connected to a single input means or other controller module to receive the same input, such that the vertical lifts move together. The work surface 206 may be adjusted for sitting and standing configurations. The vertical position of the work surface 206 may be synchronized or otherwise correspond to the vertical position of the slat rail 218, for example, to coordinate the positions of the primary and secondary displays. The apparatus 200 may include one or more central controllers (e.g. operably connected to lift controllers 310 and 312 in FIG. 24) that automatically adjusts the height of the slat rail 218 responsive to adjustment of the work surface. The controller may include a processor and memory and input means for receiving input to adjust the height of the work surface 206 and/or slat rail 218. When synchronized, a single input device may adjust the height of both the work surface 206 and/or slat rail 218. Alternatively, two or more controllers or input devices may be used to control the heights separately and individually. The horizontal position of the slat rail 218 may also be coordinated or synchronized with the height of the work surface 206 in some embodiments.

Horizontal and/or vertical movement of the apparatus 200 may be controlled by a single user interface that is coupled (directly or indirectly) to the motor 242 (FIG. 16A) and the controllers 310 and 312 (FIGS. 23 and 24).

The slat rail 218 in this example includes a hollow or partially hollow lower portion 318 for cable management (i.e. providing a cable pathway for equipment mounted to the slat rail 218). Holes 320 are provided for access to the hollow lower portion 318.

The upper body section 214 and the lower body section 216 of the apparatus 200 also provide storage space in their interiors that may be used to store various equipment, cable management etc. For example, cable trays 325 and 326 are included in the lower body section 216 (see FIGS. 23 to 25), and a cable tray 327 is included in the upper body section 216 (see FIGS. 24 and 25). Equipment such as computer hardware, power outlets, control boxes etc. may also be stored in the upper and lower body sections 214 and 216.

It is to be understood that the structure and configuration of the apparatus 200 is show by way of example. Embodiments are not limited to the particular frame structure 270 shown.

Figure 26:
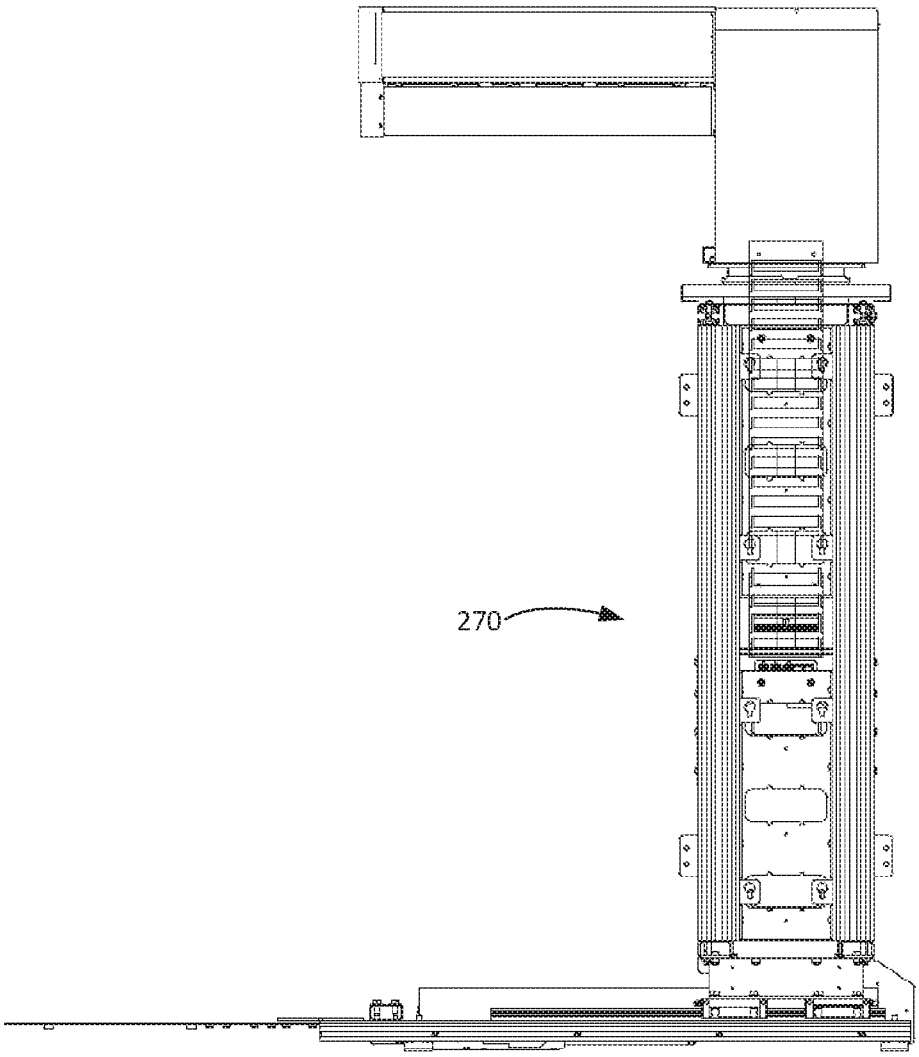
FIG. 26 is a side view of the apparatus of FIGS. 23 to 25B.
Figure 27:
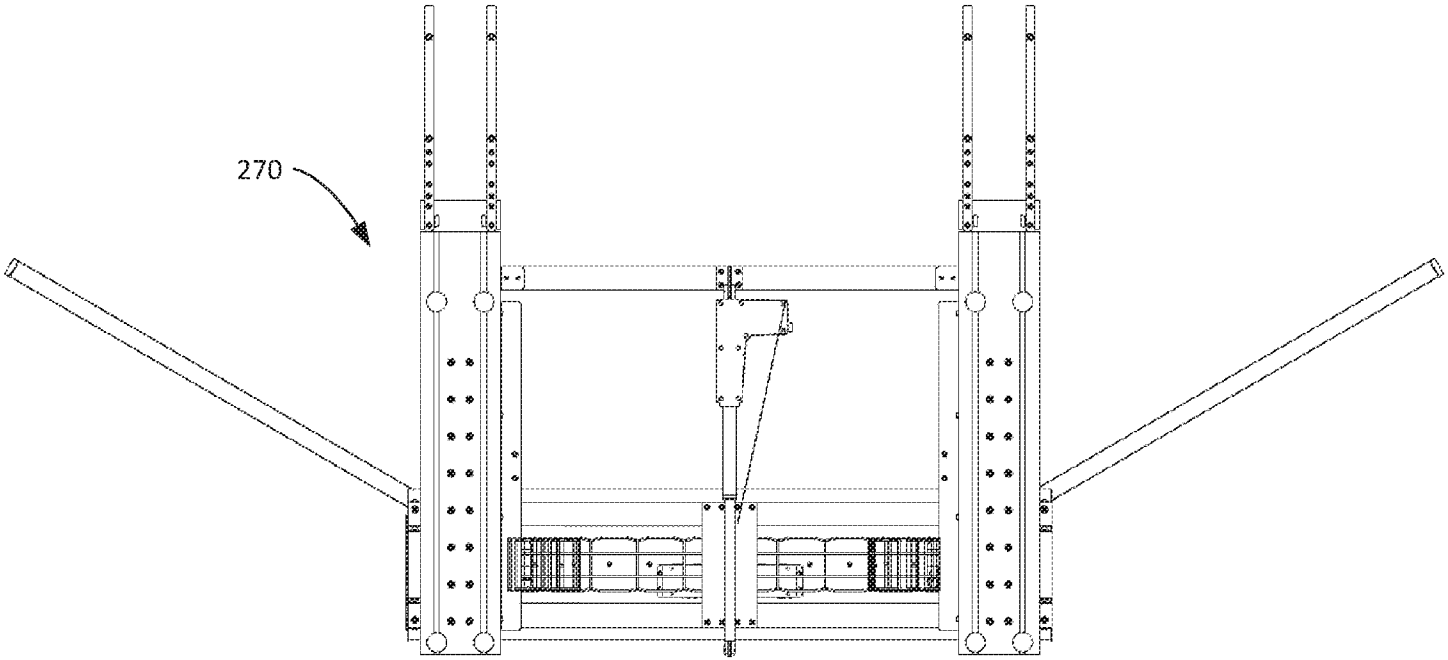
FIG. 27 is a bottom view of the apparatus of FIGS. 23 to 26.
Figure 28:
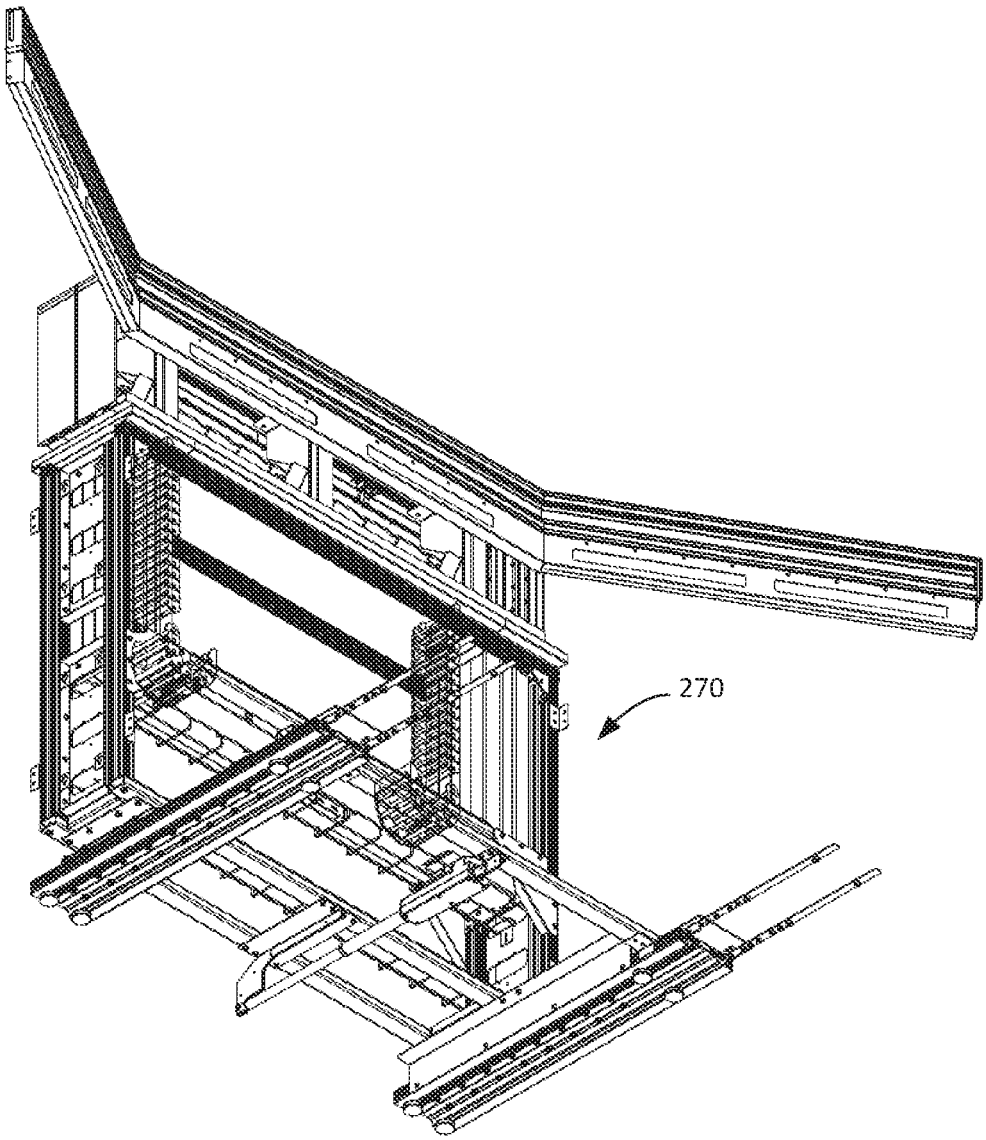
FIG. 28 is a bottom perspective view of the apparatus of FIGS. 23 to 25B.
Figure 29:
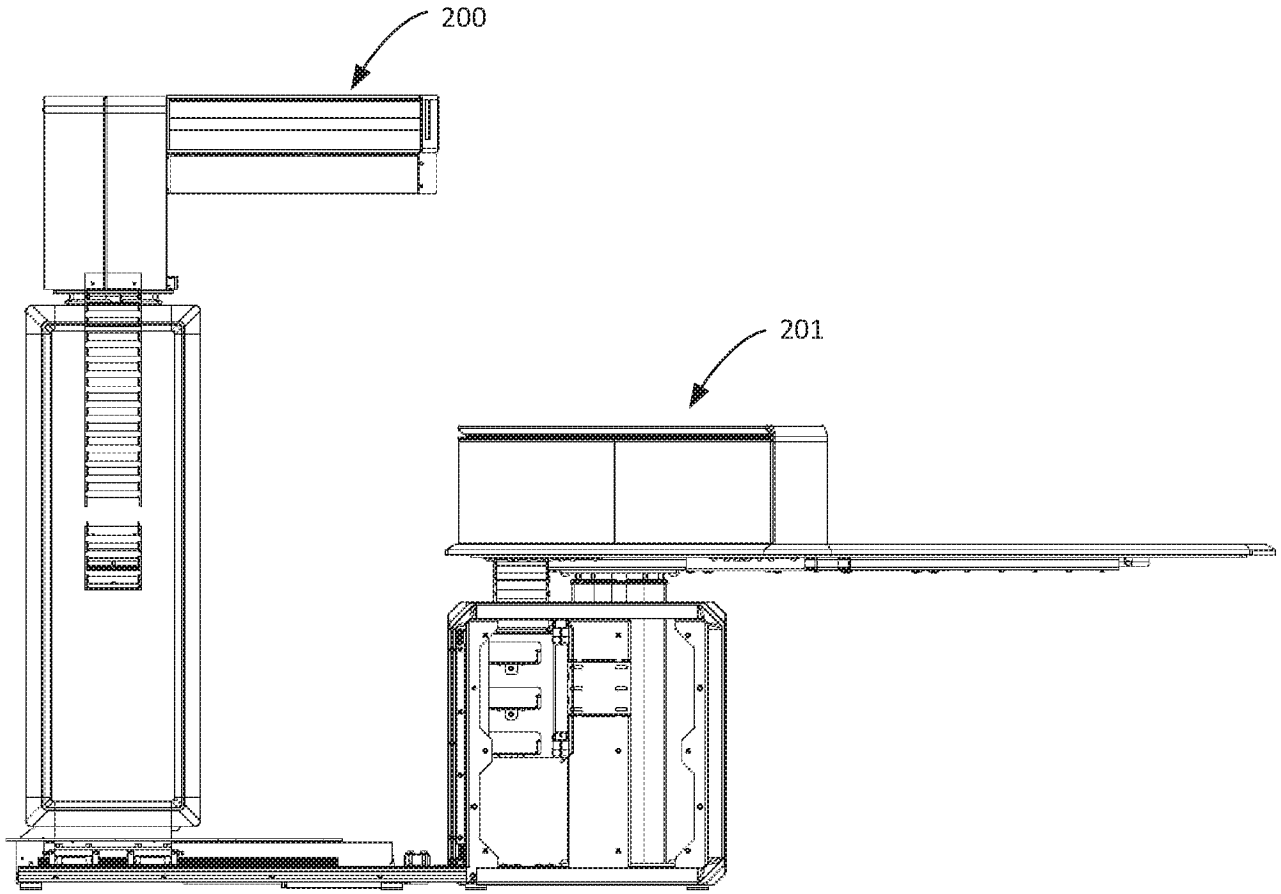
FIG. 29 is a side view of the apparatus of FIGS. 23 to 28 and the example console as shown in FIGS. 11 to 16A.

FIGS. 26 to 28 are side, bottom, and perspective views, respectively, of the apparatus frame structure 270 of the apparatus 200. FIG. 29 is a side view of the apparatus 200 attached to the console 201 also shown in FIGS. 11, 12 and 14.

Turning again to FIG. 11, the vertical position of the work surface 206 may be synchronized or otherwise correspond to the vertical position of the slat rail 218, for example, to coordinate the positions of the primary and secondary displays. The apparatus 200 may include a central controller (not shown) connected to individual controllers or motors of the console 201 and the apparatus 200 in order to automatically adjust the height of the slat rail 218 responsive to adjustment of the work surface 206 (or vice versa). The central controller may include a processor and memory and may be connected to a user interface for receiving input to adjust the height of the work surface 206 and/or slat rail 218. When synchronized, a single user input device or user interface (e.g. button(s), touch screen, etc.) may be used to control the height of both the work surface 206 and/or slat rail 218. Alternatively, two or more controllers or user input devices may be used to control the heights separately and individually. The horizontal position of the slat rail 218 may also be coordinated or synchronized with the height of the work surface 206 in some embodiments.

In some embodiments, a console may include the apparatus 100 of FIG. 1 and the apparatus 200 of FIG. 11. For example, "primary" displays or other equipment may be mounted on the apparatus 100 mounted on a work surface, and "secondary displays" or other equipment may be mounted on the apparatus 200 mounted behind the console. The console and both apparatuses 100 and 200 may be coupled to a central controller (e.g. including a processor and memory) that controls the work surface of the console, and the vertical and horizontal movement of both apparatuses 100 and 200. The vertical and/or horizontal positions of the primary and secondary displays may be synchronized or otherwise coordinated with each other. Similarly, as discussed above, the positions of the primary and secondary displays may be synchronized with the work surface of the console.

It is to be understood that the various structural components (e.g. panels, covers, frames, beams, etc.) described herein may comprise metal or any other suitable material. For example, one or more covers may comprise wood, plastic, or composite materials. Embodiments are not limited to any particular materials.

According to another aspect, there is provided a method for making an equipment mounting apparatus, such as the example apparatuses 100 and 200 shown in FIGS. 1 to 12 and 15 to 29 and described above.

Figure 30:
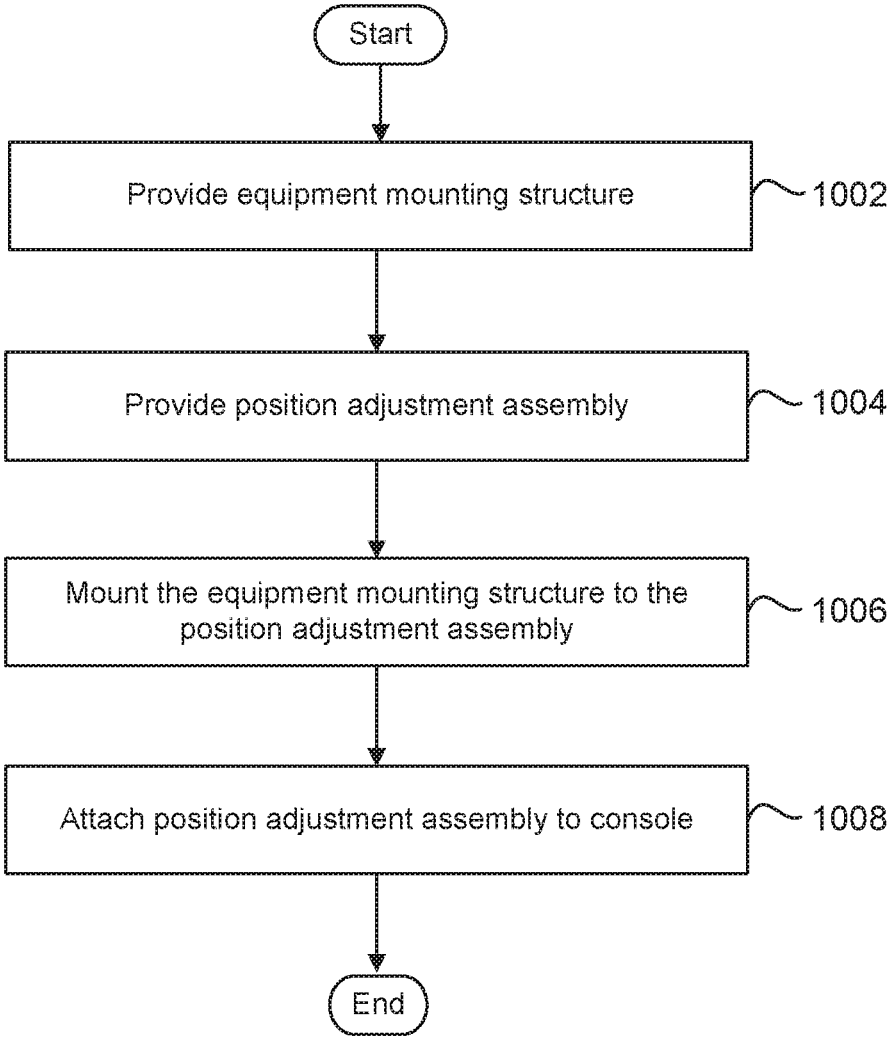
FIG. 30 is a flowchart of a method for making an equipment mounting apparatus according to some embodiments.

FIG. 30 is a flowchart diagram of an example method according to some embodiments.

At block 1002, an equipment mounting structure is provided for mounting equipment thereto. The equipment mounting structure may, for example, comprise a slat rail or a slat wall. Providing the equipment mounting structure may comprise purchasing, making, or otherwise obtaining the equipment mounting structure.

At block 1004, a position adjustment assembly is provided that is mountable to a console. The position adjustment assembly comprises at least one of: a horizontal position adjustment mechanism; and a vertical adjustment mechanism. The horizontal adjustment mechanism may comprise, for example, one or more guiderails. The vertical adjustment mechanism may comprise, for example, one or more vertical lifts. The horizontal position adjustment mechanism and/or vertical adjustment mechanism may be powered (e.g. motor driven). Providing the position adjustment assembly may comprise purchasing, making, or otherwise obtaining the position adjustment assembly.

At block 1006, the equipment mounting structure is mounted to the position adjustment assembly, thereby allowing vertical and horizontal adjustment of a position of the equipment mounting structure.

The method may optionally, at block 1008, further comprise attaching the position adjustment assembly to a console, thereby allowing vertical and horizontal adjustment of the position of the equipment mounting structure relative to the console. attaching the position adjustment assembly to the console may comprise mounting the position adjustment assembly on one or more work surfaces of the console (similar to the apparatus 100 in FIG. 1). Alternatively, attaching the position adjustment assembly to the console may comprise connecting the position adjustment assembly at a rear of the console (e.g. to one or more leg structures) similar to the apparatus 200 in FIG. 2). Embodiments are not limited to any particular method or place of attachment or to a position of the position adjustment assembly relative to the console.

In some embodiments, providing the position adjustment assembly comprises assembling the position adjustment assembly by coupling the vertical adjustment assembly to the horizontal adjustment assembly. The coupling may be direct or indirect. For example, in the case of vertical lifts and guiderails, the vertical lifts may be coupled directly to the guiderails. Alternatively, the vertical lifts may be indirectly coupled to the guiderails via a support structure, as in the examples shown in FIGS. 1 to 29.

What has been described is merely illustrative of the application of the principles of the disclosure. Other arrangements and methods can be implemented by those skilled in the art without departing from the scope of the present disclosure.

The invention claimed is:

1. An apparatus for use with a console, the apparatus comprising:

a display mounting structure for mounting a display thereto; and a position adjustment assembly mountable to the console, the display mounting structure being mounted to and supported by the position adjustment assembly, the position adjustment assembly comprising:

a horizontal adjustment mechanism for adjusting a horizontal position of the display mounting structure relative to the console;

a vertical adjustment mechanism for adjusting a vertical position of the display mounting structure relative to the console; and a support structure, the horizontal adjustment mechanism and the vertical adjustment mechanism each being connected to the support structure, wherein the horizontal adjustment mechanism is mountable to a work surface of the console, the support structure is mounted to the horizontal adjustment mechanism, and the vertical adjustment mechanism is mounted to the support structure.

2. The apparatus of claim 1, wherein the horizontal adjustment mechanism comprises at least one guide rail.

3. The apparatus of claim 1, wherein the vertical adjustment mechanism comprises at least one vertical lift.

4. The apparatus of claim 1, wherein the console comprises a work surface and the horizontal adjustment mechanism comprises at least one guiderail mountable to the work surface.

5. The apparatus of claim 4, further comprising a horizontal actuator and a motor, wherein the horizontal actuator is coupled to the support structure, and the motor drives the horizontal actuator to move the support structure horizontally relative to the at least one guiderail.

6. The apparatus of claim 1, wherein the display mounting structure is connected to the vertical adjustment mechanism and is vertically adjustable relative to the support structure.

7. The apparatus of claim 1, wherein the console comprises one or more leg structures, and the apparatus is connected to the one or more leg structures of the console.

8. The apparatus of claim 7, further comprising one or more feet, each of the one or more feet of the apparatus being connectable to a respective one of the one or more leg structures of the console.

9. The apparatus of claim 8, wherein, the horizontal adjustment mechanism is mounted to the one or more feet of the apparatus, the support structure is mounted to the horizontal adjustment mechanism, and the vertical adjustment mechanism is mounted to the support structure.

10. The apparatus of claim 9, wherein the horizontal adjustment mechanism comprises at least one guiderail, and each said at least one guide rail is mounted to a respective one of said one or more feet of the apparatus.

11. The apparatus of claim 9, wherein said support structure is a first support structure, the apparatus further comprises a second support structure that is above the first support structure, and the vertical adjustment mechanism interconnects the first and second support structures.

12. The apparatus of claim 11, wherein the display mounting structure is connected to the second support structure.

13. The apparatus of claim 1, wherein the display mounting structure comprises one of: a slat rail and a slat wall.

14. The apparatus of claim 1, wherein the console comprises a work surface that is vertically adjustable, and at least one of the horizontal adjustment mechanism and the vertical adjustment mechanism comprises a controller that automatically adjusts the position of the display mounting structure responsive to vertical movement of the work surface.

15. A console system comprising:

a console comprising at least one work surface; and an apparatus attached to the console, the apparatus comprising:

a display mounting structure for mounting a display thereto; and a position adjustment assembly mountable to the console, the display mounting structure being mounted to and supported by the position adjustment assembly, the position adjustment assembly comprising:

a horizontal adjustment mechanism for adjusting a horizontal position of the display mounting structure relative to the console;

a vertical adjustment mechanism for adjusting a vertical position of the display mounting structure relative to the console, and a support structure, the horizontal adjustment mechanism and the vertical adjustment mechanism each being connected to the support structure, wherein the horizontal adjustment mechanism is mounted to the work surface of the console, the support structure is mounted to the horizontal adjustment mechanism, and the vertical adjustment mechanism is mounted to the support structure.

16. A method comprising:

providing a display mounting structure for mounting a display thereto; and providing a position adjustment assembly that is mountable to a console, the position adjustment assembly comprising:

a horizontal position adjustment mechanism;

a vertical adjustment mechanism; and a support structure, the horizontal adjustment mechanism and the vertical adjustment mechanism each being connected to the support structure, wherein the horizontal adjustment mechanism is mountable to a work surface of the console, the support structure is mounted to the horizontal adjustment mechanism, and the vertical adjustment mechanism is mounted to the support structure; and mounting the display mounting structure to the position adjustment assembly, thereby allowing vertical and horizontal adjustment of a position of the display mounting structure.

17. The method of claim 16, further comprising attaching the position adjustment assembly to a console, thereby allowing vertical and horizontal adjustment of the position of the display mounting structure relative to the console.

* * * * *